United States Patent [19]

Hermes

[11] 4,248,290

[45] Feb. 3, 1981

[54] FOUNDRY MOLDING MACHINE AND METHOD

[75] Inventor: Rudolf Hermes, Parma, Ohio

[73] Assignee: The Osborn Manufacturing Corporation, Cleveland, Ohio

[21] Appl. No.: 64,008

[22] Filed: Aug. 6, 1979

[51] Int. Cl.[3] ..... B22C 19/04; B22C 9/20

[52] U.S. Cl. ..... 164/154; 164/323

[58] Field of Search ..... 164/154, 155, 4, 323, 164/18, 27; 198/502, 857

[56] References Cited

U.S. PATENT DOCUMENTS 3,958,621 5/1976 Hatch ..... 164/173

*Primary Examiner*—Robert D. Baldwin
*Assistant Examiner*—K. Y. Lin
*Attorney, Agent, or Firm*—Maky, Renner, Otto & Boisselle

[57] ABSTRACT

A foundry molding machine of the horizontal stack type such as shown in Hatch U.S. Pat. No. 3,958,621 employs a programmable solid state electrical control system operating in conjunction with a closed-loop hydraulic servo-system to obtain greater flexibility of set-up and higher mold uniformity and precision with fewer reject molds. Each of four of the major moving components of the machine may be provided with an encoder or position, velocity and direction monitoring device, such components being the two opposed squeeze rams, the mold traction device, and the pusher. Such monitors not only measure the final position of one squeeze ram, but also enable the calculation or measurement of the mold thickness so that the pusher cylinder can be controlled during its movement to contact a formed cake at a null condition and to move that cake into contact also at a null condition with a horizontally formed stack. While the mold thickness and the final position of the squeeze plates will vary for each mold formed, the positions and thicknesses may be determined for each cycle so that the pusher may be controlled to engage the mold at a slow or substantially zero velocity, accelerate to move the cake toward the stack, and again slow to a substantially zero velocity to bring the cake into engagement with the stack before further accelerating and moving the cake with the stack by a synchronous drive with the mold traction device.

48 Claims, 13 Drawing Figures

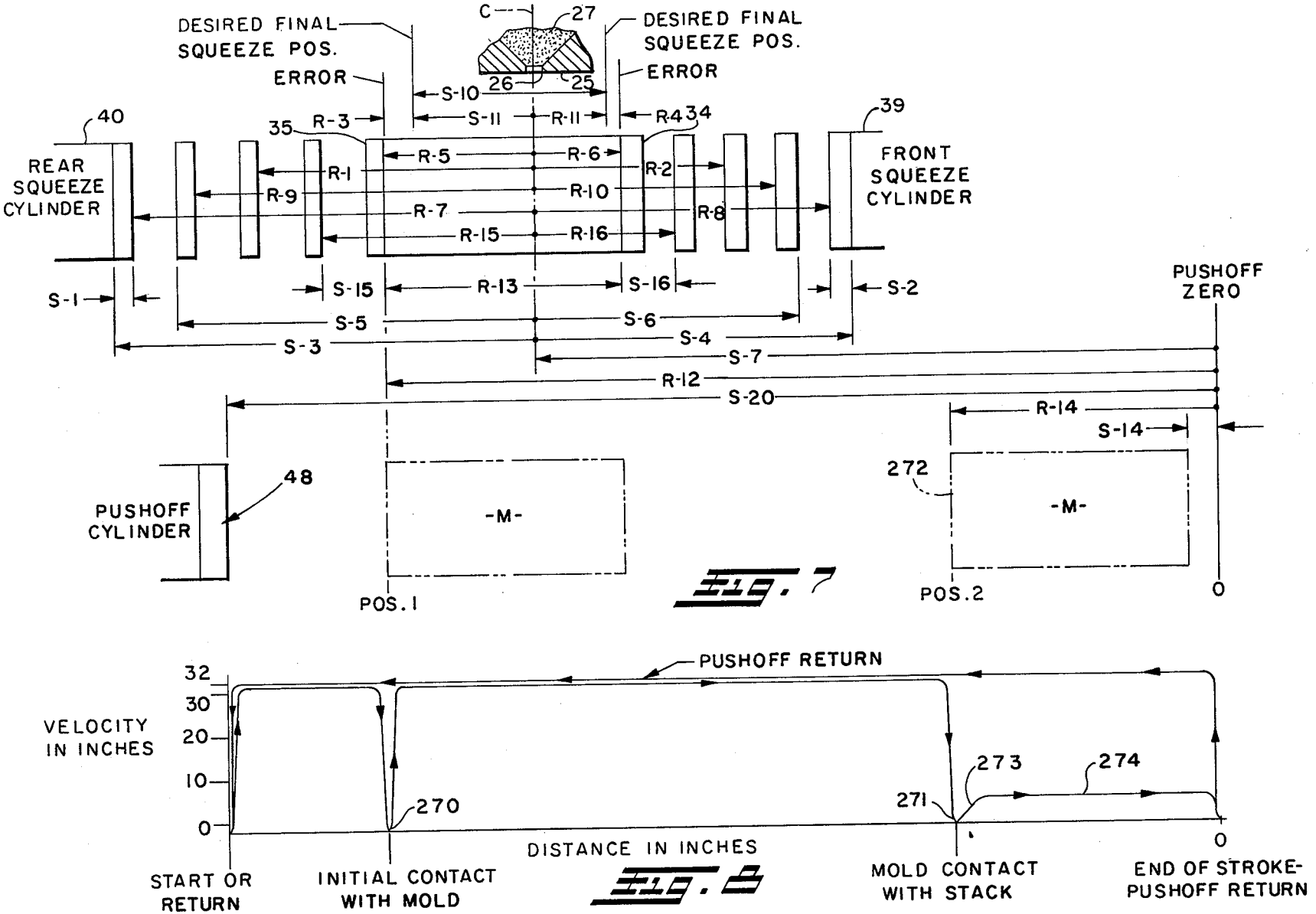
PUSHOFF ZERO
0
S-14
R-14
-M-
POS. 2
272
FRONT SQUEEZE CYLINDER
39
S-2
S-7
S-20
S-4
S-6
R-12
S-16
R-13
S-15
S-5
S-3
S-1
R-1
R-2
R-3
R-4
R-5
R-6
R-7
R-8
R-9
R-10
R-11
R-15
R-16
34
35
40
REAR SQUEEZE CYLINDER
DESIRED FINAL SQUEEZE POS.
ERROR
DESIRED FINAL SQUEEZE POS.
ERROR
S-10
S-11
C
27
25
26
-M-
POS. 1
48
PUSHOFF CYLINDER
PUSHOFF RETURN
274
273
271
270
END OF STROKE-PUSHOFF RETURN
MOLD CONTACT WITH STACK
INITIAL CONTACT WITH MOLD
START OR RETURN
DISTANCE IN INCHES
VELOCITY IN INCHES
32
30
20
10
0

FOUNDRY MOLDING MACHINE AND METHOD

This invention relates generally as indicated to a foundry molding machine and method and more particularly to a foundry molding machine of the horizontal stack type such as shown in Hatch U.S. Pat. No. 3,958,621.

In such horizontal stack foundry molding machines, two relatively large hydraulic rams opposed to each other move within a mold box which has been blown full of molding sand to compress and form therebetween a foundry sand cake which may have a pattern impressed on one or both faces. When the cake is thus formed, the rams, with the patterns thereon, are withdrawn and the cake is transferred to a position in line with a horizontal stack of such cakes which are moved incrementally and uniformly beneath a pouring station and then through a cooling station.

In order to place the just formed cake against the stack and to move the stack at least the thickness of one cake, a pusher is employed which engages the stack and moves it against the stack and then moves the stack forwardly. The pusher then retracts to pick up the next formed cake.

When the cakes are relatively large, the pressures required to move the same and the stack are substantial. Because of a wide variety of conditions, the amount of molding sand forming each cake is never precisely the same and the thickness of each cake formed varies slightly. Such variations may result from conditions such as temperature, humidity, or simple imprecision in the blowing operation which may affect the flowability and thus the amount of molding sand introduced into the cake during each cycle. Therefore, the pusher cannot anticipate the precise point of contact with the cake and the cake with the stack since such points of contact may vary for each cake formed. The only way such contact can be anticipated is to determine the final position of the corresponding pattern relative to the pusher to anticipate the pusher-cake contact position and to calculate the final cake thickness to anticipate the cake-stack contact position. Ideally, the pusher should come to a complete stop at the calculated position before accelerating with the cake and should then come to another complete stop at the calculated position where the cake contacts the stack before further acceleration. This avoids momentum contact between the pusher and cake and the cake and stack which may cause damage to the molds.

Also, because of a wide variety in the configurations of the patterns employed, variations in the final position of the patterns with respect to the mold center line or blow opening must be obtained, such positions also affecting the clearance positions as well as the length and extent of slow draw operations, it is important that the control system permit the operator to set or dial in a wide variety of dimensional parameters, including certain optimum conditions which will permit adjustments or variations upon the completion of each cycle depending upon the tolerance variations from an optimum position achieved in the previous mold or cake.

BACKGROUND OF THE INVENTION

In order to alleviate the cake crushing or damage problem, a wide variety of mold traction devices or conveyor control systems have been employed. Hydraulic traction devices may be seen in Lundsgart U.S. Pat. No. 4,040,472 and Hatch U.S. Pat. No. 4,129,208.

Also, pressure responsive devices have been employed to control the movement of the stack. Reference may be had to Montgomery U.S. Pat. No. 3,800,935 wherein a pressure sensing transducer is employed to sense the hydraulic pressure operating a ram, the ram being utilized to push a plurality of cakes onto a conveyor. Obviously, such a pressure sensing device or transducer cannot sense a change in pressure until contact is made.

Reference may also be had to Gaspar U.S. Pat. No. 4,112,999 wherein signals from the control system of the well known DISAMATIC machine are employed to index the cooling conveyor.

SUMMARY OF THE INVENTION

With the present invention there is provided a horizontal stack foundary molding machine and method wherein the variable cake thickness components are continuously monitored. The machine incorporates a programmable control system operating in conjunction with a closed-loop hydraulic servo-system.

The finished mold thickness can be dialed in with a minimal allowable size, that is, the controls may calculate the proper blow chamber dimension and position, which will result in a finished mold within a proper dimension. The control system takes into account the pattern stool and pattern thickness, which may vary, the amount of compressability of the molding sand, which may vary, and any error monitored from the previous cycle. Such controls calculate both the mold thickness and determine the final squeeze position of the rear cylinder mold face. The information is stored and employed to control the movement of the pusher cylinder.

The pusher cylinder advances and slows down for contact with the new mold by using the final squeeze position of the rear cylinder mold face as a reference. It preferably slows to a null condition or a complete stop. Then it will advance rapidly and slow down again just before the cake being pushed thereby contacts the stack of molds. Again it preferably slows down to a complete stop. The stop position is obtained by using the mold thickness dimension calculated previously. At this point the pusher and traction device advance the entire mold stack as a unit. In such condition, the pusher cylinder is the controlling cylinder and the traction cylinder merely mimics the pusher cylinder. Synchronization between the pusher and the mold traction device is achieved by sensing the position of both with monitors, preferably optical encoders, driven by both cylinders. The system senses the position error in the pulse output from the pusher cylinder and traction cylinder, and the traction cylinder servo-pump will receive the proper command to reduce the error signal to zero, keeping the molds closed without crushing. The mold stack will start slowly and then advance rapidly until the pusher cylinder has completed its stroke.

The control system is such that it will continually attempt to position the squeeze cylinders or patterns in such a way that the final mold thickness corresponds to a dialed in dimension which is an optimum dimension to take advantage of a given pattern configuration. Furthermore, if the mold thickness is below the selected minimum dimension, the machine automatically ejects the mold.

The machine also has the capability to produce an oversized mold to act as a buffer mold after the last poured mold of a batch. Molds are normally poured in batches since the ladle from which they are poured must be periodically refilled. When the pourer comes back with a filled ladle, he should be able to pour this oversized mold. This eliminates the normally followed practice of skipping a mold when starting to pour from a newly filled ladle. A control system permits the frequency of this oversized mold to be adjusted to coincide with the number of molds that can be poured from one ladle.

In addition to the primary monitoring of the positions of the components and the calculations derived therefrom, the machine also provides a wide variety of both dialed-in or preset variations as well as functions which may be calculated therefrom. It is important that such variations be readily available. For example, operating conditions such as temperature and humidity may affect molding sand density requiring machine parameter changes. Also, if the pattern or patterns change, such factors as offset from centerline, extent and duration of slow draw, clearances, finished mold thicknesses, and mold thickness low tolerance should be quickly capable of being programmed into the machine without requiring lengthy set-up and trial and error runs.

It is accordingly a principal object of the present invention to provide a horizontal stack foundry molding machine which includes a variable speed pusher and control means therefor for controlling the speed of the pusher so that it engages the cake at substantially zero velocity and so that the cake engages the stack also at such substantially zero velocity.

Another principal object is the provision of a horizontal stack foundry molding machine wherein the final position of the face of the mold on the same side as the pusher is determined as well as the mold thickness to control the null points of the pusher as it engages the cake, and as the cake engages the stack.

A further principal object is the provision of a horizontal stack foundry molding machine wherein the position of one face of the mold is determined on each cycle together with the position of the other face so that the first face and the mold thickness may be determined to control the movement of the pusher to avoid engagement with the cake and the cake with the stack in a manner which may damage or unduly stress the molds.

Another important object is the provision of such machine wherein a wide variety of parameters may readily be dialed into the machine to vary the positions, stroke, and rate of movement of various components for each cycle of the machine.

Still another object is the provision of a machine wherein the machine may produce at a desired interval a buffer mold larger than the molds normally produced.

Still another object is the provision of a machine wherein the mold thickness low tolerance may be preset so that the machine will automatically eject a mold below such tolerance.

A further object is the provision of a horizontal stack molding machine wherein an optimum mold thickness may be preselected with the machine continuously correcting its parameters to try to obtain such mold thickness.

Still another object is the provision of a machine of the type indicated wherein the front and rear pattern stool thicknesses may be dialed in.

Still another object is the provision of such machine wherein the front and rear maximum depth from the centerline of the mold may be selected by dialing in the desired dimension.

A further object is the provision of a machine wherein the various parameters of the draw may be selected.

A still further object is a machine of the type indicated wherein the required clearances for any given pattern and its projections may be selected.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In said annexed drawings:

FIG. 6 is a schematic electrical diagram of a portion of the programable electrical control system for the pusher cylinder, such being typical of the controls employed for the front and rear squeeze cylinders as well as the mold traction cylinder;

FIG. 7 is a schematic top plan illustration of the machine showing the two squeeze plates, the pusher, and the stack, and also illustrating some of the various dimensions and positions which may be selected and read or calculated with the present invention;

FIG. 8 is a velocity-distance diagram of the motion of the pusher cylinder showing an exemplary initial contact with the finished mold or cake and the initial contact of the cake with the stack;

DESCRIPTION OF THE PREFERRED EMBODIMENTS

Figure 1:
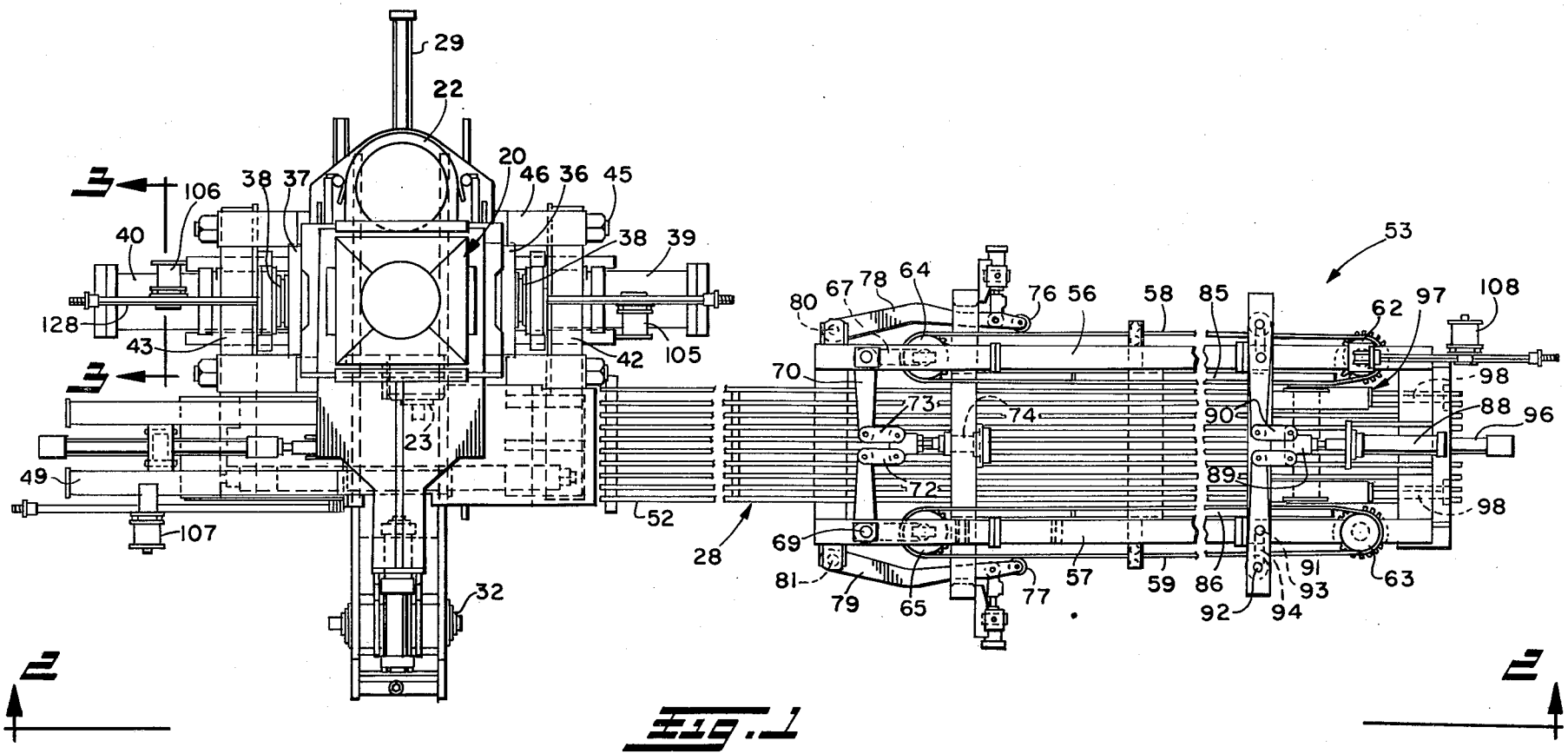
FIG. 1 is a top plan view of a machine in accordance with the present invention with the pouring and cooling conveyor partially broken away.
Figure 2:
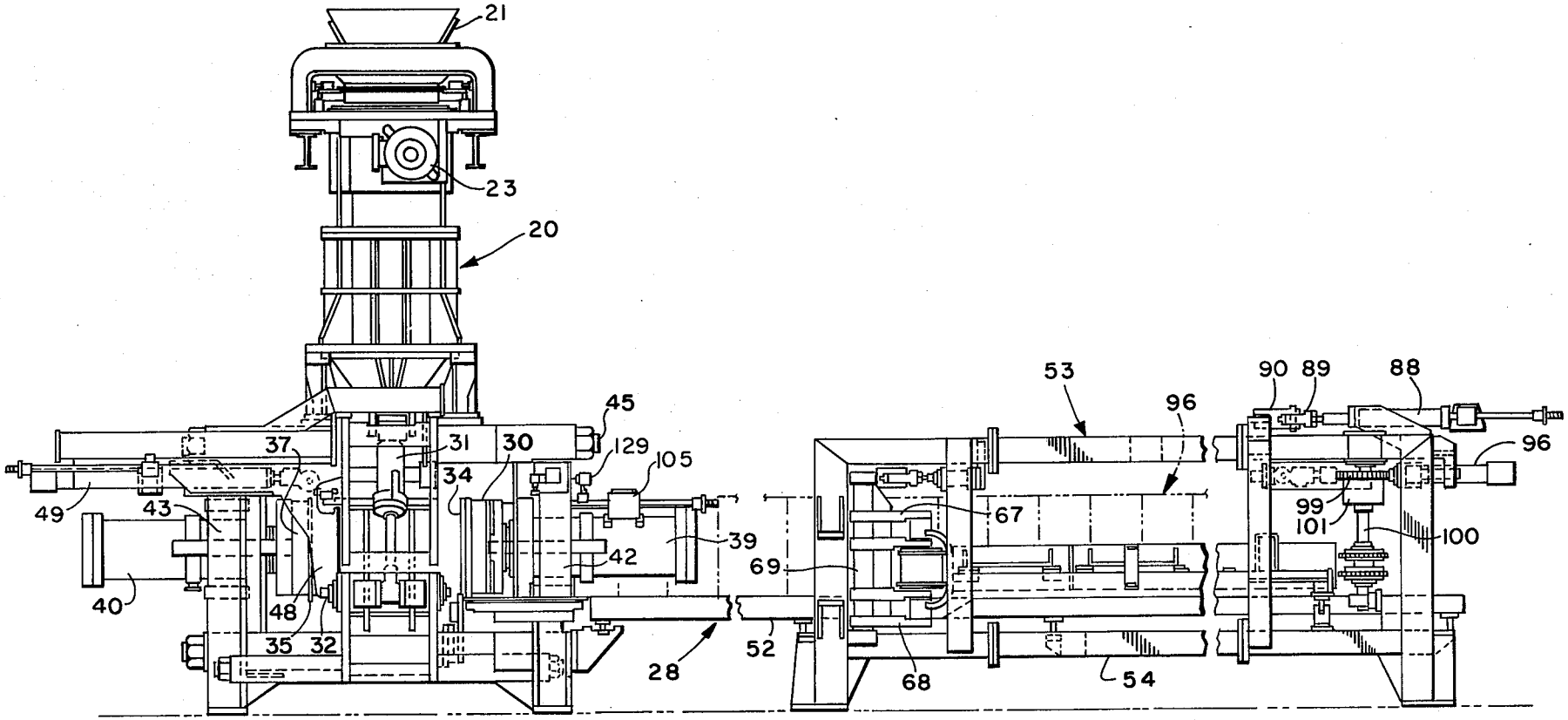
FIG. 2 is a front elevation of the machine shown in FIG. 1 taken substantially from the line 2—2 thereof.

The Machine-General Arrangement (FIGS. 1 and 2)

The machine of the present invention is generally similar to the machine shown in U.S. Pat. No. 3,958,621 and reference may be had to such patent for the details of construction of the several components of the machine. A blow reservoir 20 is charged with a metered amount of molding sand from hopper 21 wwhen shuttle type metering plate 22 is indexed to the open position. After the reservoir is charged with molding sand, the plate 22 is indexed to the position seen in FIG. 1 and is sealed. The sand charge is then ready to be blown into the mold box by energization of the blow valve 23.

The mold box into which the molding sand is blown is situated directly beneath the reservoir and includes a fixed top wall 25 provided with a blow slot 26 through which the molding sand 27 from the reservoir is blown into the box. The top wall and slot are shown schematically in FIG. 5.

In addition to the fixed top wall, the mold box includes one fixed side wall on the side of the machine opposite the pouring and cooling conveyor shown generally at 28. This would be at the top of FIG. 1 or at the side of the machine away from the viewer in FIG. 2. The fixed side wall may include a movable close-up plate actuated by air cylinder 29. The opposite side wall and bottom wall of the mold box are movable as a unit from a mold box forming position beneath the reservoir 20 cooperating with the fixed and one side wall to a discharge position in line with the pouring and cooling conveyor 28. Movement of the movable side and bottom walls of the mold box is obtained by transfer piston cylinder assembly 31 oscillating a link pivoted at 32, such link in turn being link connected to the movable bottom and one side wall of the mold box. The construction and operation of the mold box or carriage for opening and closing movement is more clearly seen in the aforementioned Hatch U.S. Pat. No. 3,958,621. The close-up or follower plate ensures the mold moves with the carriage and remains in proper position thereon.

In the closed position of the mold box, the box forms a generally rectangular open ended frame, the open ends of which are designed to accommodate horizontally movable front and rear pattern plates 34 and 35 mounted adjustably on front and rear pattern stools shown generally at 36 and 37, respectively. The respective patterns and stools are mounted on the relatively large rams or rods 38 of front and rear squeeze cylinders 39 and 40. Such front and rear squeeze cylinders are mounted on vertically extending frames 42 and 43, respectively, which are interconnected by four relatively large tie rods 45 extending through horizontal sleeves 46. The ram of each squeeze piston cylinder assembly may incorporate a jolt mechanism as seen more clearly in the aforementioned Hatch U.S. Pat. No. 3,958,621.

When the mold box is closed or formed, the patterns of the front and rear squeeze cylinders will be positioned to close the open ends of the box. When thus closed, sand is blown into the mold box filling the same. The front and rear squeeze cylinders then move toward each other compressing the sand within the box into a firm dense mold sand cake. The front and rear pattern plates are then withdrawn through certain slow draw procedures to a clear position. When the patterns are clear of the patterned surfaces or faces of the mold sand cake, the piston cylinder assembly 31 is actuated to move the thus formed sand cake into position in alignment with the pouring and cooling conveyor 28 and ahead of sand cake push-off plate 48, shown in its retracted position, and which is actuated by relatively long stroke hydraulic piston cylinder assembly 49. When the mold cake is in alignment with the pouring and cooling conveyor, the pusher extends first to contact the mold cake and then to move the mold cake onto the pouring and cooling conveyor then to cause engagement of the mold cake with a horizontal stack of previously formed mold cakes. Further extension of the piston cylinder assembly 49 then indexes not only the just formed mold cake but the entire stack of mold cakes along the pouring and cooling conveyor 28. The movement of the pusher 48 as typically obtained by the pusher piston cylinder assembly 49 is seen more clearly in schematic FIGS. 7 and 8.

The pouring and cooling conveyor 28 as a bed or support for the mold cakes comprises a series of horizontally disposed bars or rails 52 along which the mold cakes slide. Such rails pass through a mold traction device shown generally at 53 which assists in moving the stack of cakes along the conveyor 28 to relieve some of the interface pressure between adjacent mold cakes to preclude crushing. The mold traction device includes a bed frame 54 and two side frames 56 and 57. The side frames at each side of the mold stack on the conveyor rails 52 support a continuous chain or mesh belt as seen at 58 and 59, respectively. Such belts are trained around drive sheaves 62 and 63 at one end of the traction device and around idler sheaves 64 and 65 at the opposite end. The idler sheaves are each journaled on shafts interconnecting the distal ends of pivot arms 67 and 68 secured to pivot shafts 69 which are each pivoted in opposite directions as viewed in FIG. 1 by relatively long arms 70, each in turn connected by relatively short links 72 to the rod fixture 73 of relatively short piston cylinder assembly 74. In this manner extension of the piston cylinder assembly 74 which is secured to the frame will move the idler sheaves 64 and 65 toward each other and vice versa. In this manner the piston cylinder assembly 74 moves the traction chains or belts in and out at the entrance end of the mold traction device.

As seen more clearly in FIG. 1, the return flight of each side belt includes a tensioning roller as seen at 76 and 77 mounted on the ends of relatively long arms 78 and 79 pivoted at 80 and 81, respectively. Relatively small piston cylinder assemblies 83 and 84 may be employed to pivot the arms 78 and 79, thus controlling the pressure of the rolls 76 and 77 on the belts controlling the tension thereof.

The middle section of the mold traction device for each belt may include a belt back-up indicated generally at 85 and 86 which may include a plurality of belt back-up rollers supported by a pressure beam movable slightly toward and away from the lateral sides of the stack of sand cakes on the conveyor rails 52. The pressure frames are controlled for movement toward and away from the sides of the sand cakes independently of the belt by means of piston cylinder assembly 88, the rod fixture 89 of which is connected by two relatively short links 90, each of which are connected to relatively long links 91 pivoting vertical shafts 92 in turn moving vertically paired pressure rollers 93 through relatively short arms 94. The pressure rollers force the pressure beams toward and away from the lateral sides of the sand cake shown in phantom lines at 96.

In this manner the lateral distance between the idler sheaves 64 and 65 of the traction belts at the entry end of the conveyor may be controlled by piston cylinder assembly 74. The pressure of the back-up frames or pressure beams 85 and 86 forcing the belt against the lateral sides of the mold stack may also be controlled by the piston cylinder assembly 88.

Movement of the belts is obtained by hydraulic piston cylinder assembly 96 which reciprocates H-shape frame 97 on guide rods 98. The two lateral legs of such frame include outwardly projecting racks in mesh with pinions 99 connected to the vertically extending sheave shafts 100 through overrunning clutches 101. Reference may be had again to the aforementioned Hatch U.S. Pat. No. 3,958,621 for a more clear disclosure of the drive for such belts.

Optical Incremental Encoders

Figure 3:
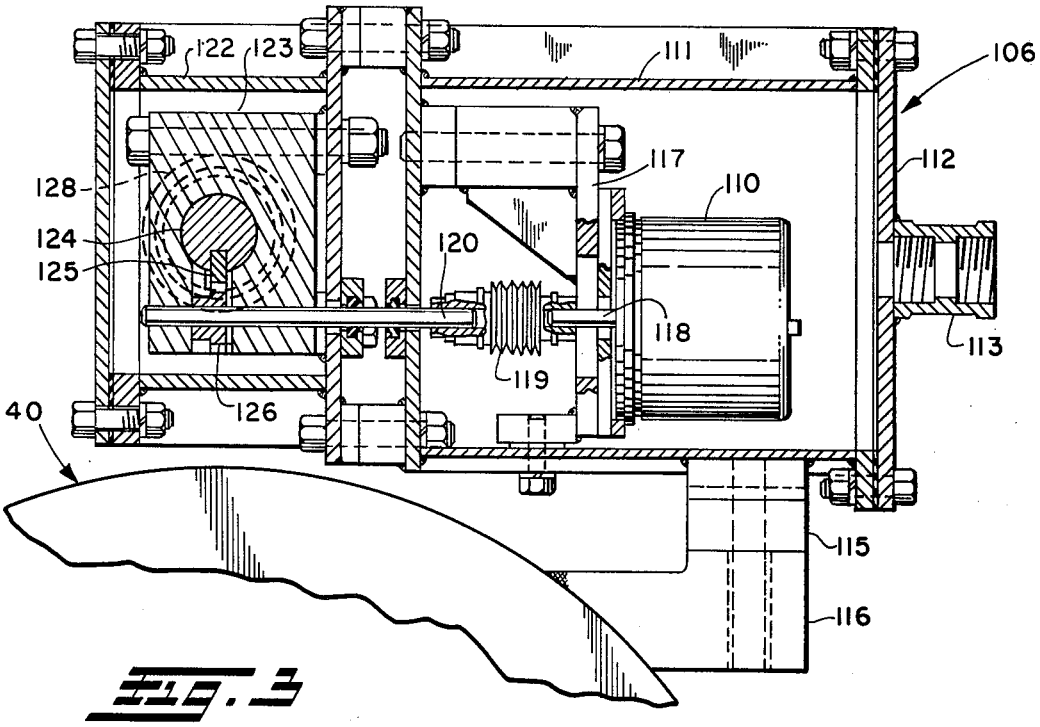
FIG. 3 is an enlarged fragmentary vetical section taken substantially on the line 3—3 of FIG. 1 illustrating the monitoring device or optical encoder employed to monitor the position of the rear squeeze plate, such encoder being typical of the four employed.
Figure 9:
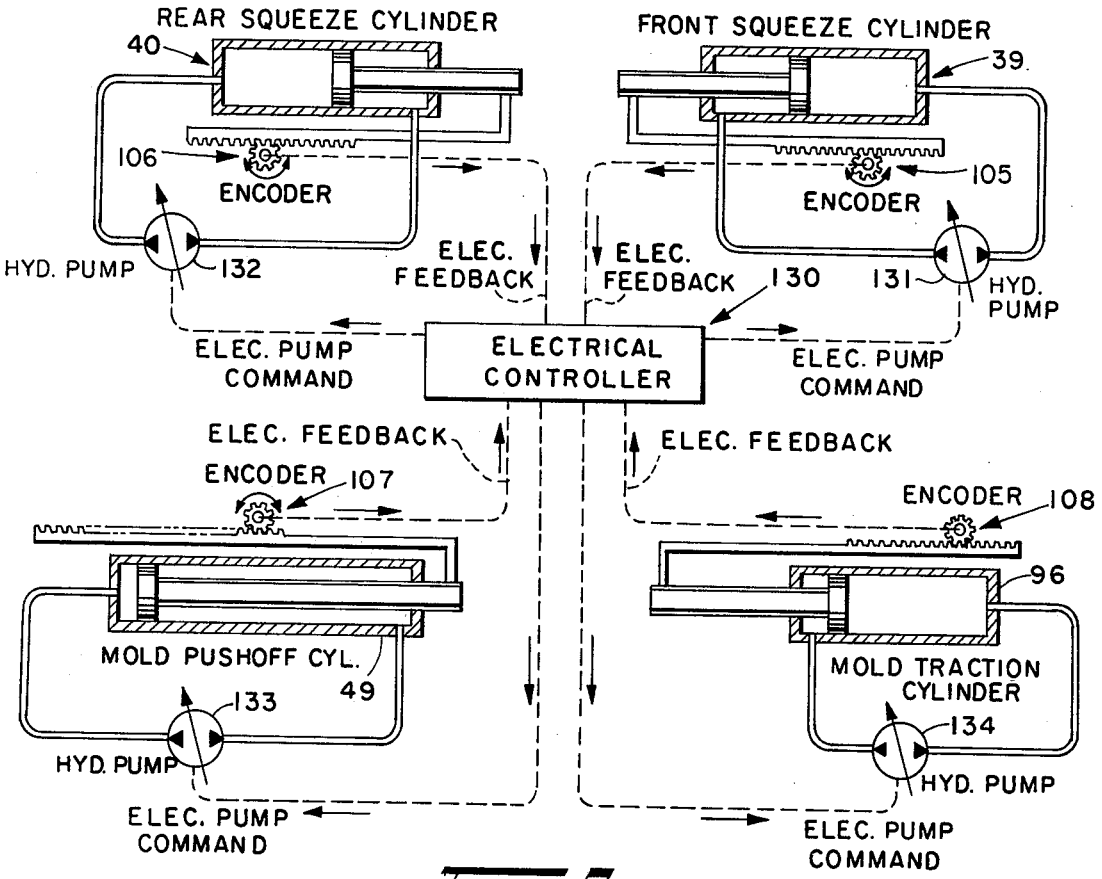
FIG. 9 is an overall schematic showing the command and feedback connections to the programable controller for each of the major cylinders of the machine.

Referring now additionally to FIG. 3 and schematic FIG. 9 it will be seen that each of the four major piston cylinder assemblies of the machine includes either connected directly or indirectly to the piston of the assembly an optical incremental encoder. As seen more clearly in FIG. 1, the encoder for the front squeeze cylinder 39 is seen at 105, while the encoder for the rear squeeze cylinder 40 is seen at 106. Such encoder and its mounting is also seen more clearly in FIG. 3. The encoder for the pusher cylinder is seen at 107 while the encoder for the traction device cylinder is seen at 108.

Referring now more particularly to FIG. 3 it will be seen that the optical encoders are each mounted in similar fashion to be driven for rotation by linear movement of a rack connected directly or indirectly to the piston of the respective cylinder. In FIG. 3 the actual encoder is shown at 110 mounted within housing 111 which includes a sealed cover 112 having union 113 secured thereto for electrical conduit, not shown. The housing is supported on spacer 115 from bracket 116 secured to the cylinder 40. The optical encoder 110 is mounted on a mounting plate 117 and its shaft 118 extends through the mounting plate and is connected by a phase adjust coupling 119 to the projecting end of pinion shaft 120. The shaft 120 extends from the housing 111 into housing 122 for bearing block 123 through which slides rod 124 normal to the plane of the Figure. Secured to the rod, as a key in a slot, is encoder rack 125. The encoder rack drives pinion 126 to rotate through the phase adjust coupling 119 the encoder drive shaft 118. The rod 124 is of course connected directly to the rod of the piston cylinder assembly 40 and is parallel thereto. The rod 124 is supported and journaled in a protective cylindrical housing 128.

The optical incremental encoder instrument 110 may be of the type sold by Sequential Information Systems, Inc. of Elmsford, New York and may include a photo transistor and an amplifier. The encoders may be provided with two tracks phase shifted 90 electrical degrees for direction sensing and also are provided with count multiplication for minute increment position sensing. With such optical encoders, not only can speed and direction be sensed, but also position at any given time up to 0.001 in.

The rods which drive the encoders through the rack and pinion drive may also be employed adjustably to trip microswitches controlling the limits of movement of the respective cylinders. One such microswitch is seen at 129 in FIG. 2.

As seen more clearly in FIG. 9, the encoders provide an electrical feed-back to programable electrical controller 130 which in turn electrically controls or commands the swash plates of hydraulic pumps 131–134 for the front squeeze cylinder 39, the rear squeeze cylinder 40, the pusher cylinder 49, and the mold traction cylinder 96, respectively.

Hydraulic Circuit

Figure 4:
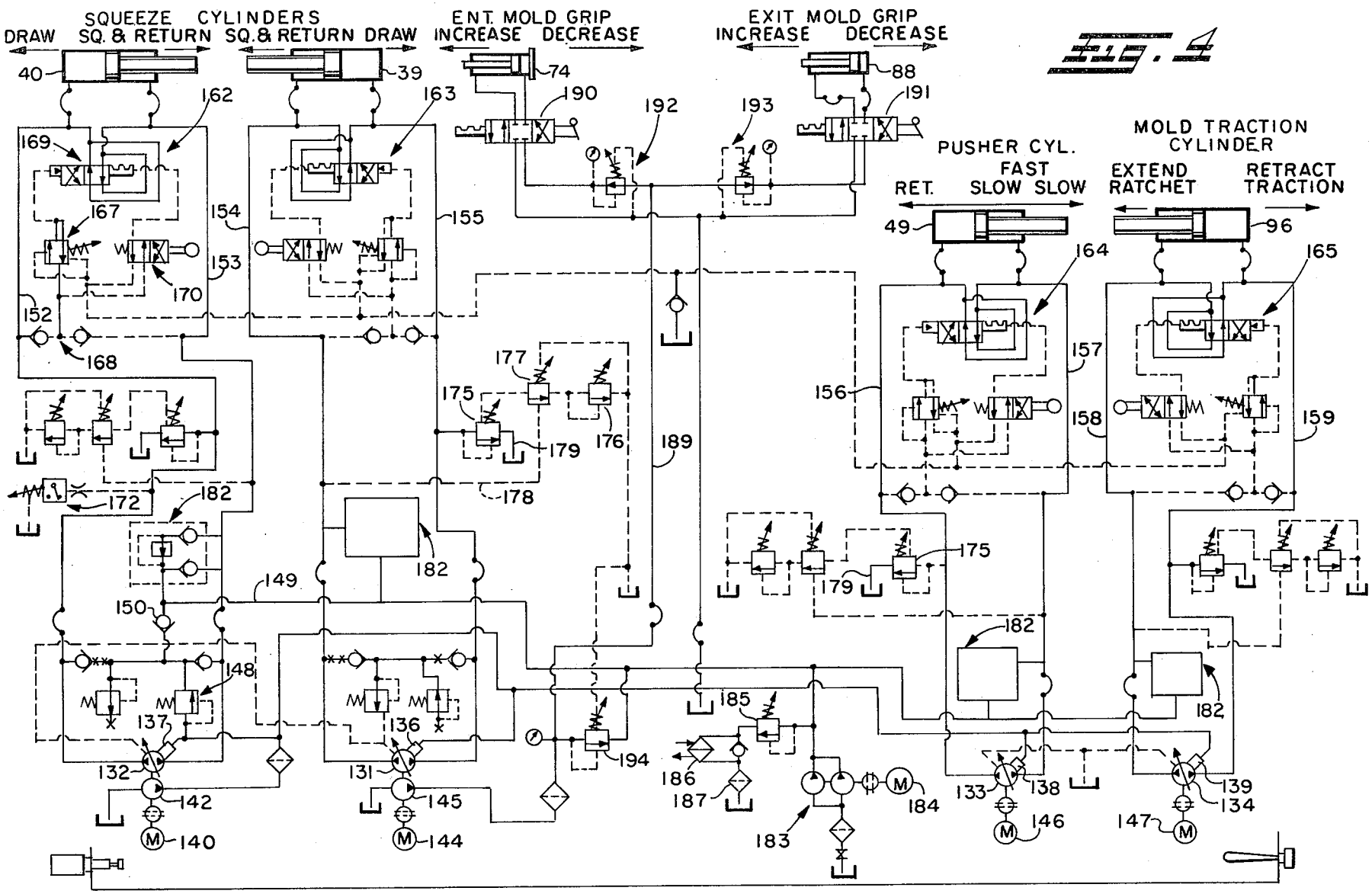
FIG. 4 is a schematic illustration of the hydraulic control system which may be employed with the present invention.
Figure 5:
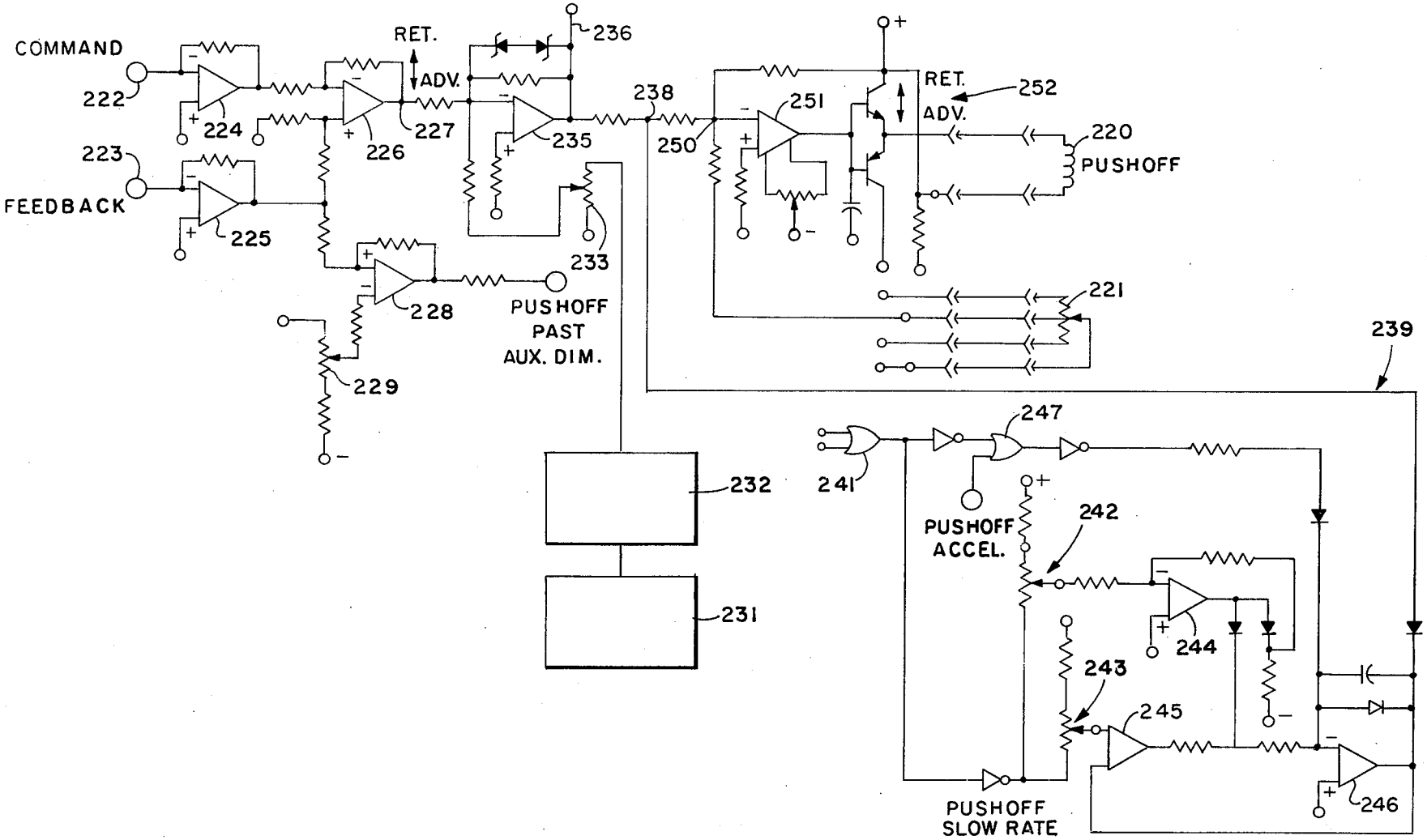

Referring now to FIG. 4, the principal components of the hydraulic circuit actuating the four major cylinders of the machine are illustrated, and also actuating the mold grip cylinders 74 and 88 at the entrance and exit of the mold traction device as seen in FIG. 1.

As indicated, each major cylinder 40, 39, 49 and 96 is provided with its respective pump seen at 132, 131, 133 and 134. Each such pump may be a variable displacement in-line piston pump with a hydraulic electrically actuated servo-control as seen at 136, 137, 138 and 139 for the respective pumps. The pump 132 is driven by motor 140 which also drives gear pump 142 which supplies hydraulic fluid to all of the servo-values 136–139.

Similarly, the pump 131 for the squeeze cylinder 39 is driven by motor 144 which also drives gear pump 145 supplying hydraulic fluid to line 146 to the mold grip piston cylinder assemblies 74 and 88. The pumps 133 and 134 are driven by motors 146 and 147, respectively.

The pumps 132 and 131 each include two relief valves as indicated at 148 and such valve 148 may be employed to limit the pressure at the servo to approximately 350 psi and put any excess pressure into the replenishing system line 149 through check valve 150. The other relief valve illustrated may be disconnected.

From the pump 132 hydraulic pressure is applied to the bind end of squeeze cylinder 40 through line 152 and to the rod end through line 153. Similarly, the pump 131 supplies pressure to the rod end of squeeze cylinder 39 through line 154 and the blind end through line 155. The pump 133 supplies fluid pressure to the blind end of pusher cylinder 49 through line 156 and to the rod end through line 157. Similarly, the pump 134 supplies pressure to the rod end of mold traction cylinder 96 through line 158 and to the blind end through line 159. Each of the paired lines for the major piston cylinder assemblies is provided with a hydraulic fuse circuit as seen at 162, 163, 164 and 165, respectively. Each fuse circuit includes an adjustable sequence valve 167 designed to sense over pressure through shuttle valve 168. Upon such over pressure, detent valve 169 shifts bypassing the piston cylinder assembly and stays in such shifted position until reset. The detent valve may be reset only by manually shifting palm button valve 170. Thus all of the major cylinders are provided with a hydraulic fuse circuit which must be manually reset in the event of over pressure.

The line 152 which connects the pump 132 to the blind end of the rear squeeze cylinder 40 is provided with a pressure transducer seen at 172. The pressure transducer is used to sense the squeeze pressure on the mold and its setting may be dialed in to create a zero voltage differential at the desired setting. The tripping of the pressure transducer at the desired setting indicates that the desired squeeze pressure on the mold has been obtained.

Connected to the pressure line leading to the blind end of each of the four major cylinders is a pair of relief valves as seen at 175 and 176 with a sequence valve 177 interposed therebetween. The pilot line of the sequence valve seen at 178 is connected to the pressure line for the rod end of each cylinder. Accordingly, the sequence valve will be open when the squeeze cylinder retracts and close when the squeeze cylinder extends during squeeze. Accordingly, during retraction, the setting of the relief valve 176 controls the opening of the relief valve 175 and during such retraction fluid in the large cylinder is dumped back to tank through relatively large line 179. However, during squeeze, the sequence valve is closed and the pressure setting of the valve 175 controls the opening thereof. The valve 175 may be set at a much higher value, for example 2,000 to 2,500 psi while the valve 176 may be set from 40 to 50 psi.

The replenishing line 149 is connected to the pressure line to the rod end of each of the major cylinders through a respective replenishing relief valve seen at 182. The relief valves which are connected to the replenishing line 149 replenish only the rod end of the major piston cylinder assemblies and limit the pressure in the return lines to approximately 1,650 psi. The settings of the replenishing relief valves in the pusher cylinder and mold traction cylinder return lines may be set lower.

Hydraulic fluid for the replenishing line 149 is supplied by pumps 183 driven by motor 184. A relief valve 185 dumps the hydraulic fluid back to tank through heat exchanger 186 and filter 187.

The output of gear pump 145 pressurizes line 189 which is connected to manually operated three position control valves 190 and 191. After the stack of cakes is formed on the conveyor and through the mold traction device the grips will be extended and the pressure obtained by such grips is controlled at 192 and 193, respectively. Excessive pressure in the line 189 is dumped through relief valve 194 into the replenishing line 149.

While FIG. 4 illustrates the hydraulic circuit for the major cylinder components of the machine, it will be appreciated that there are additional components of the machine which may be operated pneumatically. For example, the guard, blow seal, slide, blow valve, carriage, jolt rams, pattern blow back and slow draw vibrators may be pneumatically operated.

Programmable Controller

Figure 5:
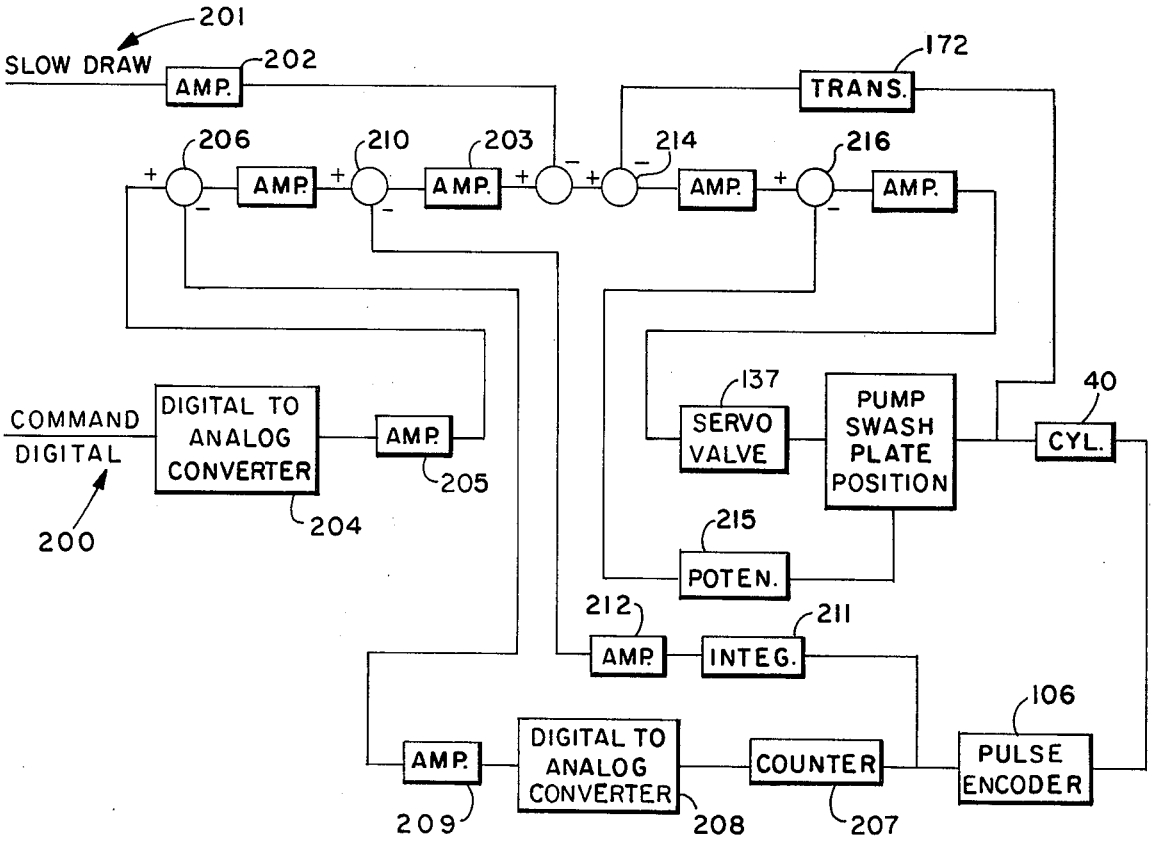
FIG. 5 is a highly schematic illustration of the controls portion of the programmable controller employed, for example, for one of the squeeze cylinders.

Referring now to FIGS. 5 and 6 there is illustrated exemplary electrical controls for one of the squeeze cylinders in FIG. 5 and for the push-off cylinder in FIG. 6.

Referring first to FIG. 5 it will be seen that the cylinder 40 may be controlled by certain dialed-in commands as indicated at 200 as well as by a dialed-in slow draw command as indicated at 201. The signal from the slow draw command is amplified as indicated at 202 and moves to summing junction 203. The digital command 200 passes through digital-to-analog converter 204, amplifier 205, and moves to summing junction 206.

The encloder 106 which is connected to the rod of the cylinder 40 provides a position feed-back to summing junction 206 through counter 207, digital-to-analog converter 208 and amplifier 209. The encoder 106 also provides a velocity feed-back to summing junction 210 through integrator 211 and amplifier 212. The encloder 106 thus provides both a position and a velocity feed-back with the former providing a precise measure of the location of the pattern plate. Pressure transducer 172, also seen in FIG. 4, provides a feed-back signal to summing junction 214 while a potentiometer 215 locating the position of the pump swash plate provides a feedback signal to summing junction 216. The various summing junctions are interconnected by amplifiers as indicated and collectively control the servo valve 137 moving the pump swash plate of pump 132 controlling the cylinder 40. It is noted that the pressure transducer 172, even though sensing the pressure on one cylinder only, nonetheless provides an electrical feedback to both squeeze cylinders.

While the squeeze cylinders have some additional command and feed-back controls, for all of the main cylinders of the machine, three feed-back commands are common. One is the position as obtained from the encoder, the second is the velocity as obtained from the encoder, and the third is the pump delivery feed-back as determined by the position of the swash plate potentiometer on the swash plate.

Referring now to FIG. 6, there is illustrated the control circuitry for the mold push-off cylinder 49 with the servo of the pump 133 being controlled by the coil 220. The potentiometer monitoring the position of the swash plate of the pump 133 is shown at 221. For the pusher cylinder the command signals from the digital-to-analog converters of the computer enter at 222 while the position feed-back from the encoder enters at 223. The respective signals pass through operational amplifiers 224 and 225, respectively, converting the current input to a voltage output. The signals then pass through a comparator 226. If the command and feed-back signals are identical, the output at 227 is zero.

The signal from the amplifier 225 also passes through a comparator 228 for comparison with an adjustable signal at 229 to ascertain if the push-off is past a given auxiliary dimension for mold rejection as hereinafter described.

The velocity feed-back from the encoder passes through integrating and amplifying circuits 231 and 232 and through adjustment 233 which act to stabilize and prevent oscillations. Such adjustments aid in critically damping the servo system and permit the cylinder to creep into a zero or null condition. After the velocity feed-back, the signal passes through amplifier 235 simply to magnify the signal. A further control signal is introduced to the circuitry at 236 to ensure that the push-off is properly positioned and also that the traction cylinder is properly positioned since the push-off and traction cylinder for the latter part of the stroke of the former operate in conjunction with each other. Such signal is obtained from a sensing circuit.

Figure 10:
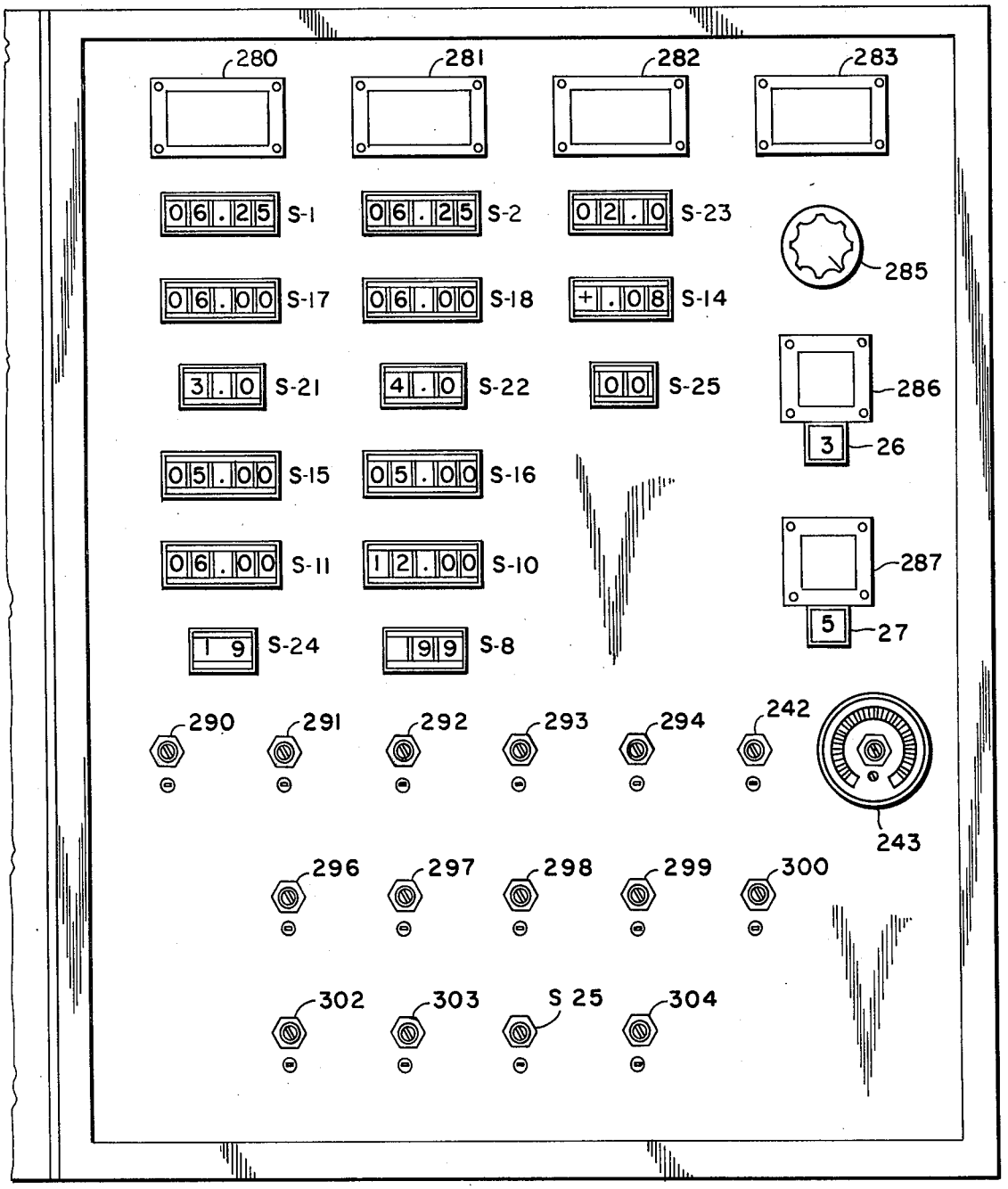
FIG. 10 is an enlarged partial view of the face of a control panel which may be used with the invention showing some of the dial-in capabilities together with certain digital read-outs.

During the latter part of the stroke of the push-off cylinder, as seen perhaps more clearly in FIG. 8, the pusher is moving the entire stack of sand cakes and it is desired to control the final push-off ramp or acceleration as well as the final somewhat slower push-off speed through this last portion of its cycle. Such modifying signals to the circuit enter at 238 and are obtained from the circuit shown generally at 239. Signals from the push-off command portion of the computer pass through or-gate 241 to pass through potentiometers 242 and 243 determining the ramp or acceleration and the final slower velocity of the push-off during its final movement as seen in the velocity distance diagram of FIG. 8. Such potentiometers are also shown in FIG. 10. The signals from the potentiometers pass through the respective amplifiers 244 and 245. The resultant signals pass through a further amplifier 246 after being joined from a signal from or-gate 247, such or gated signals all coming from the computer.

The potentiometer 221 on the swash plate of the pump 133 feeds back into the circuit at 250 with the circuit then passing through amplifier 251 and the advance and return switching 252 to control the servo valve of the push-off cylinder 49 as seen at 220.

The circuit for the traction cylinder, not shown, is perhaps the least complex, incorporating only the command and position feed-back as well as the feed-back from the potentiometer on the swash plate of the pump 134.

The squeeze cylinders which incorporate a slow draw command as seen at 201 and 202 in FIG. 5 may, like the pusher cylinder in the final portion of its stroke, incorporate potentiometer controls which may be on the control panel of the machine to provide both a front and rear slow draw ramp as well as a front and rear slow draw maximum speed. The circuitry for such adjustable acceleration and speeds may be substantially similar to the circuitry described at 239 in connection with FIG. 6.

The computer used with the control system of the present invention may be any general or special purpose digital computer and may include a variety of program registers, some of which are hereinafter more fully described.

Positional and Dimensional Capabilities of the Machine

Referring now to FIG. 7 there is illustrated essentially in top plan the various major components of the machine and there is illustrated a variety of dimensions and positions which may be set or calculated. On the drawing, the dimensions or positions are preceded by the letter R or S. If the letter R precedes the dimension, the dimension is calculated by or read from the computer. If a letter S precedes the dimension it may be set from switches or potentiometers in the control panel. Also, even though positions are indicated, the positions are shown generally by dimensions from a given reference point, the principal reference points being the zero or final position of the pusher when the pusher has moved the stack of molds as far to the right as possible. The other major reference point is the centerline of the blow opening indicated by the letter C in FIG. 7. Normally these two reference points will not vary. Accordingly, the dimension S7 from the push-off zero position to the centerline of the blow opening 26 as seen at C is a parameter of the machine and will not vary.

While the position of the blow opening centerline C will not vary, the position of the squeeze plates 34 and 35 in their final squeeze positions may be varied with respect to the centerline C. Theoretically it is desirable to have the centerline C in the center of the volume of the mold or cake and the position of the centerline vis-a-vis the squeeze plates may vary depending upon the size, volume and configuration of the patterns on such plates.

As seen in FIG. 7, each of the squeeze plates may have five reference positions, such positions being, reading from out to in, the full back calibrated position, the fine calibrated position, the blow position, the clear position, and the final squeeze position. As indicated, the final squeeze position may deviate from the desired final squeeze position by the errors indicated at R3 and R4. The error may be plus or minus. In FIG. 7 the error is shown greatly exaggerated but will occur from mold to mold because of variations in the volume of molding sand mix blown into the mold and such other conditions as temperature and humidity.

As indicated by the dimensions S1 and S2, the pattern and stool thickness may be dialed in and selected. As the patterns change, so may the pattern and stool thickness. The front and rear full back calibrations S4 and S3 may also be dialed in and from a simple subtraction process, the front and rear full back rough dimensions R8 and R7 may be calculated. The front and rear fine calibration positions S6 and S5 may also be dialed in and again subtracting S2 and S1, the front and rear fine dimensions R10 and R9 may be calculated. The fine calibration positions of the front and rear pattern plates may be used as a reference point to obtain zero error on the counters driven by the encoders. During the cycle of the machine, the pattern plates will retract generally only to the fine calibration position. They will go back to the full back position only for pattern change. The use of the fine calibration position as a reference point for the counter eliminates error accumulation in the counter in that the fine calibration position will reset the counter every cycle. The decade counters employed with the encoder are sometimes susceptible to "glitch" which adds an extra count. In any event at the fine calibration position the counter is always reset and any accumulation of error which may result from "glitch" is avoided.

Although not shown in FIG. 7, a dimension S8 may be dialed in providing a mold thickness low tolerance. If for some reason such as insufficient sand being blown into the chamber, the mold thickness is not within a minimal thickness tolerance, the machine will function to eject the mold.

The machine will not only reject a too thin mold but will also reject any mold which is made without tripping the pressure transducer. Thus, if the mold is too thin or if the set squeeze pressure is not obtained, the mold will be automatically ejected. Such undersize or underpressurized mold or sand cake will automatically be pulled out of the machine by the back side of the pusher. The pusher is simply positioned ahead of the reject mold and retraction of the pusher ejects the mold to the left as seen in FIG. 1 or 2. A mold of course can also be ejected by visual inspection. The cake is simply returned to the squeeze position, the pusher moves forward, the cake then returns, and the pusher then ejects the mold out the back of the machine.

The desired mold thickness dimension S10 may be selected on the control panel as well as the dimension S11 which is the desired final squeeze position of the rear face or pattern with respect to the centerline C. From the selected dimensions or positions S10 and S11, the calculated dimension R11 can readily be obtained. Such dimension is the front face offset from the centerline.

Another selected dimension is the traction compression offset seen at the far righthand side of FIG. 7. The traction offset dimension may be set in very fine increments and may be positive or negative. The increments may, for example, be on the order of 100ths of an inch. The traction offset provides a built-in system to permit the mold traction device to start slightly earlier or slightly later than the pusher. If there is a negative offset, the traction device starts first compensating for any backlash in the chain and drive of the traction device. If a positive offset is selected, the offset provides for very precise control of the physical interference between the molds in the stack, and accordingly the pressure of one mold face against the other. As the components of the machine wear, the traction offset can be adjusted accordingly.

Also shown in FIG. 7 are selected dimensions for the front and rear cylinders S15 and S16 to be retracted to be clear of the carriage which transfers the finished mold from the squeeze cylinders to the conveyor in a position to be engaged by the push-off cylinder.

Although not shown in FIG. 7, additional dimensions, parameters or factors may be dialed into the machine, some of which are shown in FIG. 10. For example, a switch or potentiometer S9 may select the maximum blow dimension. A switch or potentiometer S12 may select the mold sand compression percentage at one half. S12 is utilized in calculating the blow dimensions R1 and R2 as hereinafter described. The setting of the compression percentage for the sand mix may be obtained experimentally or as an empirical setting for the molding material much as one would compression test any material.

Another selector switch may be provided to obtain a wood block dimension. Wood blocks may be used to clear the machine, for example, or for jogging or testing purposes.

Selector switches S17 and S18, shown in FIG. 10, may be used to obtain the front and rear cylinder maximum depth from the centerline C. Selector switches S19 and S20 may be used to position the push-off clear of the carriage and in its full back position.

Selector switches S21 and S22, shown in FIG. 10, may be utilized to obtain the extent of the slow draw from final squeeze for the respective squeeze cylinders.

Selector switch S23, also shown in FIG. 10, may be employed to select the machine pace time or interval time setting. In other words, it can be used to make the machine go faster or slower.

Selector switch S24, also shown in FIG. 10, provides a buffer mold interval count. Conventionally, horizontal stack molding machines normally leave an empty mold between pours. The empty mold acts as a gas or moisture barrier while the ladle is being refilled. If for example one of every seven or eight molds must remain empty, this reduces productivity by about 12½%. Accordingly, the machine of the present invention simply produces a larger mold at the selected interval count to act as a barrier between pours avoiding the unproductivity of an empty mold.

Selector switch S25 seen in FIG. 10 provides a spray interval count while selector switches S26 and S27 may be employed to select a program register for monitoring.

Now referring again to FIG. 7 it will be seen that the dimensions R5 and R6 are the final rear and front measured squeeze dimensions from the respective pattern faces to the centerline C. These measurements are obtained by the calculate program register as hereinafter described enabling the counters driven by the squeeze piston encoders to obtain the measured mold thicknesses R5 and R6. The computer retains such measurements.

The sum of R5 and R6 is of course R13 which is the final mold thickness. From the measured dimension R5 and from the selected dimension S7 which is the push-off zero position to the centerline of the mold, the dimension R12 can readily be calculated to determine position number 1 seen in FIG. 7.

Position number 2 seen at R14 can readily be calculated by the formula $R13 \pm S14 = R14$.

Accordingly, as soon as the measurements R5 and R6 are made and stored, the positions 1 and 2 can quickly be calculated. Position 1 is obtained by adding R5 to S7 while position 2 is obtained by first adding R5 to R6 to obtain R13 and then adding or subtracting S14 to obtain R14. Accordingly, once the positions R12 (position 1) and R14 (position 2) are obtained, the pusher can be commanded to come to a stop or a complete null condition at such positions. This first null point is seen at 270 in the velocity distance diagram of FIG. 8 for the push-off plate of the push-off cylinder. As soon as the null point is achieved, the push-off cylinder accelerates again moving the mold M at fairly high velocity to position 2 where a second null point 271 is obtained. At such null point 271 at position 2 the face 272 of the mold M is then in contact with the stack. As soon as the null point 271 is achieved the pusher continues forward through the controlled ramp or acceleration 273 at the relatively slower velocity 274 obtained by the circuitry 239 in FIG. 6. The pusher then moves the mold M and the entire stack in conjunction with the mold traction device. It will be appreciated that the precise positions 1 and 2 may vary slightly for each cycle of the mold since the dimensions R5 and R6 are direct measurements of each mold produced by the machine.

The blow dimensions R1 and R2 for the pattern plates may be calculated by the formulas $S11 + S10 \times S12/100 + R3' = R1$ and $R11 + S10 \times S12/100 + R4' = R2$. The factors R3' and R4' represent the newly calculated error dimensions from S11 and R11. The new error R3' may be calculated from the formula $S11 - R5 + R3 = R3'$. R4' may be calculated from the formula $R11 - R6 + R4 = R4'$.

It is noted that the mold offset from the centerline C which of course is the difference between S11 and R11 can always be changed simply by dialing S10 and S11 since $S10 - S11$ always equals R11.

The dimensions R9 and R10, as indicated, are calculated by subtracting the dimensions S1 from S5 and S2 from S6, respectively. The dimensions R7 and R8 are similarly calculated by subtracting S1 from S3 and S2 from S4, respectively. Also, the dimensions R15 and R16 providing the rear and front clear positions of the pattern plates are calculated by the formulas $S15 + R5 = R15$ and $S16 + R6 = R16$.

The Control Panel

In FIG. 10 there is illustrated portions of the exposed control panel of the machine of the present invention. It will be appreciated that some of the switches or potentiometers for selecting the parameters of the machine may be on the interior of the control panel. The switches or potentiometers seen in FIG. 10 are, however, readily accessible to the operator.

At the top of the control panel there are provided four LED digital read-outs seen at 280, 281, 282 and 283 indicating to the operator respectively, the rear squeeze position, the front squeeze position, the push-off position, and the data monitor.

Immediately below the digital read-outs 280, 281 and 282 are selector switches S1, S2 and S23 by which the operator may set the rear pattern and stool thickness, the front pattern and stool thickness, and the machine pace time, respectively. Immediately below such switches are the switches S17, S18 and S14 by which the operator may set the rear squeeze maximum depth from centerline, front squeeze maximum depth from centerline, and the traction compression offset, respectively. Immediately below such switches are selector switches S21, S22 and S25 by which the operator may set the rear slow draw from final squeeze, the front slow draw from final squeeze, and the spray interval count, respectively. Immediately below selector switches S21 and S22 are selector switches S15 and S16 by which the operator may select the rear return to clear from final squeeze, and the front return to clear from final squeeze. Below those switches are switches S11 and S10 by which the operator may select the mold offset centerline to rear face and the finished mold thickness, respectively. Immediately below those switches are switches S24 and S8 by which the operator may select the buffer mold interval count, and the mold thickness low tolerance, respectively.

It is noted that some of the switches above described may provide the operator with selections varying only in 100ths of an inch. In any event, all of the above described switches provide the computer with binary coded parameters of the machine function as above described.

Immediately below the digital read-out 283 for the data monitor is a channel selector switch 285 by which the operator, when monitoring data, may select certain program registers. The programs selected may be viewed in the digital read-outs 286 and 287 upon the selection of the program register to be monitored through selector switches S26 and S27, respectively.

Below the selector switches above described are a number of potentiometers by which again the parameters of the machine may be controlled. In the first horizontal row of such potentiometers, reading from left to right, there is provided a potentiometer 290 by which the squeeze pressure may be controlled. This potentiometer controls the pressure transducer 172 seen in FIG. 4.

The potentiometer 291 controls the front slow draw ramp while the potentiometer 292 controls the front slow draw maximum speed. The potentiometer 293 controls the rear slow draw ramp while the potentiometer 294 controls the rear slow draw maximum speed.

The potentiometers 242 and 243 control the final push-off ramp and the final push-off maximum speed and are seen in greater detail in FIG. 6. These potentiometers control the portion of the velocity position curve seen at 273 and 274 in FIG. 8, respectively.

In the next horizontal row of potentiometers, the potentiometer 296 controls the duration of sand feed. The potentiometer 297 controls the duration of the inflation of the seal in the blow valve. The potentiometer 298 controls the blow time. The potentiometer 299 controls the exhaust time for the blow operation while the potentiometer 300 controls the seal deflate time for the blow valve.

In the final row of potentiometers, the potentiometer 302 may control the jolt time, the potentiometer 303 may control the blow back time, the potentiometer S25 (before described) may control the spray time, while the potentiometer 304 may control the hold down extend time.

As far as the computation aspects of the present invention are concerned, many of the potentiometers above described are not significant and merely represent adjustable time functions during the cycle of the machine.

The Programs

Calculate

Figure 11:
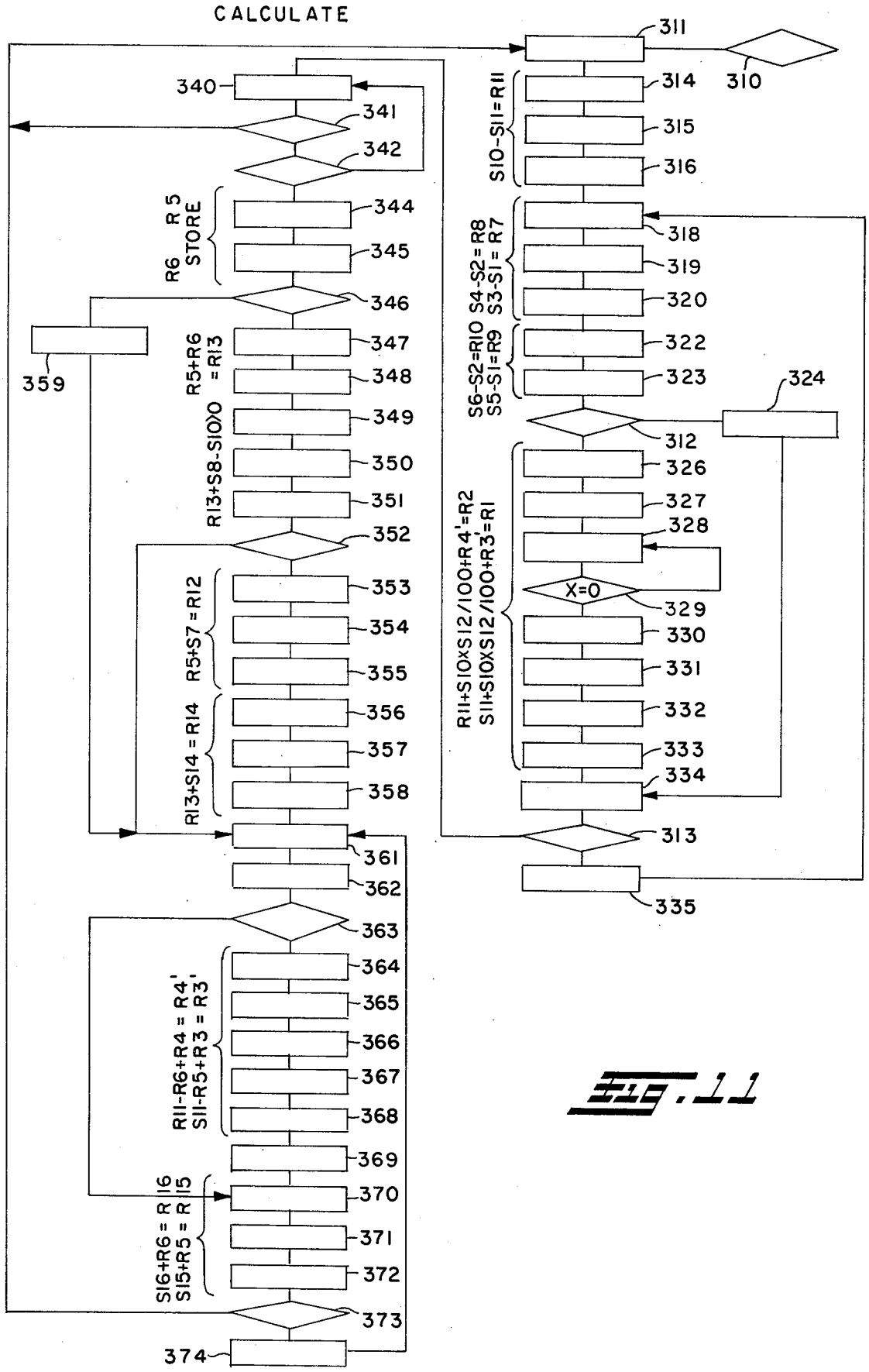
FIG. 11 is an exemplary program flow chart diagram for the programable controller of the present invention for the calculate register.

Referring now to FIG. 11 there is illustrated diagramatically a calculate program register of the present invention.

Power on indicated at 310 commences the first step 311 which is to reset flags 312 and 313 to the low position.

The next step 314 enables S10 and strobes X. Step 315 enables S11, strobes Y, subtracts and strobes Z. The final step of the calculation 316 enable Z and strobes R11 into its register. The next step 318 enables S3 and strobes X. Step 319 enables S1 and strobes Y, subtracts and strobe Z. The final step 320 in the set enables Z and strobes R7 into its register. This completes the calculation S3−S1=R7.

Step 322 enables S5 and strobes X, subtracts and strobes Z. Step 323 enables Z and strobes R9 into its register.

Flag 312 is the buffer mold flag and normally will be low. If high, step 324 enables S9 and strobes R1 into its register the first time around and R2 into its register the second time around bypassing the normal cycle blow dimension calculations set forth below.

With the flat 312 low, the next step 326 enables S10 and strobes X and resets Y. Step 327 downcounts X and upcounts Y through rate S12. Step 328 downcounts X and upcounts Y through rate S12. The flat 329 asks the question if X=zero. If the answer is no, the program pauses in the preceding step until the required job is done. If the answer is yes, the program moves on to step 330 which enables S11 and strobes X, adds and strobes Z. Step 331 enables Z and strobes X. Step 332 enables R3 and strobes Y, adds and strobes Z. Step 333 enables Z and strobes R1 into its register thus completing the calculation S11+S10×S12/100+R3'=R1. The final step 334 is a pause step.

With flag 313 low, the next step 335 is to set flag 313 high and to repeat the above described calculations from the step 318 to the flag 313. However, the second time around the steps 318, 319 and 320 will complete the calculation S4−S2=R8 with the step 320 strobing R8 into its register. The steps 322 and 323 will complete the calculations S6−S2=R10 with the step 232 strobing R10 into its register. The steps 326, 327, 328, 330, 331, 332 and 333 will complete the calculation R11+S10×S12/100+R4'=R2 with step 333 strobing R2 into its register. Accordingly, the flag 313 simply recycles the calculate program register to do the calculations for the other squeeze cylinder with each information register one higher. With the flag 313 now high, the next program step is shown at 340. This resets the flag 313 and enables the memory storage register. The next step 341 determines if the machine is on automatic cycle. If not, the program returns to its original step 311; if the machine is on automatic cycle, the program moves to the next step 342. At this time the machine is now making a mold. The step 342 inquires whether a mold has been made and has yet to be transferred to the push-off. If not, the program goes back to step 340. The step 342 then determines when the mold has been completed. This then moves the program on to steps 344 and 345 enabling the counters of the encoders for the front and rear squeeze cylinders to obtain and store the final mold dimensions R5 and R6.

In the next step, the program asks if the machine is clear as indicated at 346. If not, after pause step 347, R5 and R6 are added to obtain R13 at step 348 and it is strobed into its register. Steps 349, 350 and 351 enable S8, which as will be recalled, is the low mold tolerance. R13 is then added to S8 from which is subtracted the desired mold thickness S10 and the result is compared to zero. If the low mold tolerance is less than zero, then flag 352 is strobed and the subsequent calculations are bypassed. However, if the mold is within tolerance, the steps 353, 354 and 355 obtain R12 with the final step strobing it into its register. As it will be recalled, R5 is the final rear squeeze position obtained and stored in step 344 above while S7 is a constant or the distance from the zero to the centerline of the blow chamber as seen in FIG. 7. This establishes the initial contact point of the pusher with the mold.

The next three steps 356, 357 and 358 add R13 to S14 with the final step 358 strobing R14 into its register. R14 is the position number 2 establishing the mold contact with the stack.

Also, it is noted that if the machine is clear as indicated by the question step 346, the calculations of steps 347–351 and 353–358 may be bypassed with a single step 359 enabling S13 which is the selected dimension of the wooden block and strobing R13. In such clear condition the calculations of the bypassed steps are not important.

Steps 361 and 362 are pause steps followed by question step 363. If a buffer mold is being employed with flag 312 high or if the machine is clear with wooden blocks going through it, or if the mold has been rejected by flag 352, the next calculations are bypassed. However, in a normal cycle the program then moves on to steps 364, 365, 366, 367 and 368 obtaining the new error dimension signal R3' with the final step 368 strobing R3' into its register. The next step 369 is a pause followed by three steps 370, 371 and 372 which perform the calculation S15+R5=R15 with the final step 372 strobing R15 into its register. In this manner the pattern clear position R15 is calculated.

With the flag 373 low the program recycles through step 374 back to step 361. Step 374 resets the flag 373. In this manner the program recycles for both squeeze cylinders with each information register one higher providing the new error signal R4' for the other squeeze cylinder and also providing the clear position R16 for the other squeeze cylinder.

With the flat 373 now high, the program may recycle to pick up any new settings. If the operator makes any new settings, the program can be recycled automatically to ensure that the new settings are picked up promptly.

In any event with the exemplary program illustrated, the information required for the proper operation of the machine can readily be calculated both from the measurements taken by the machine itself and from the selected or set machine parameters.

Figures 12, 13:
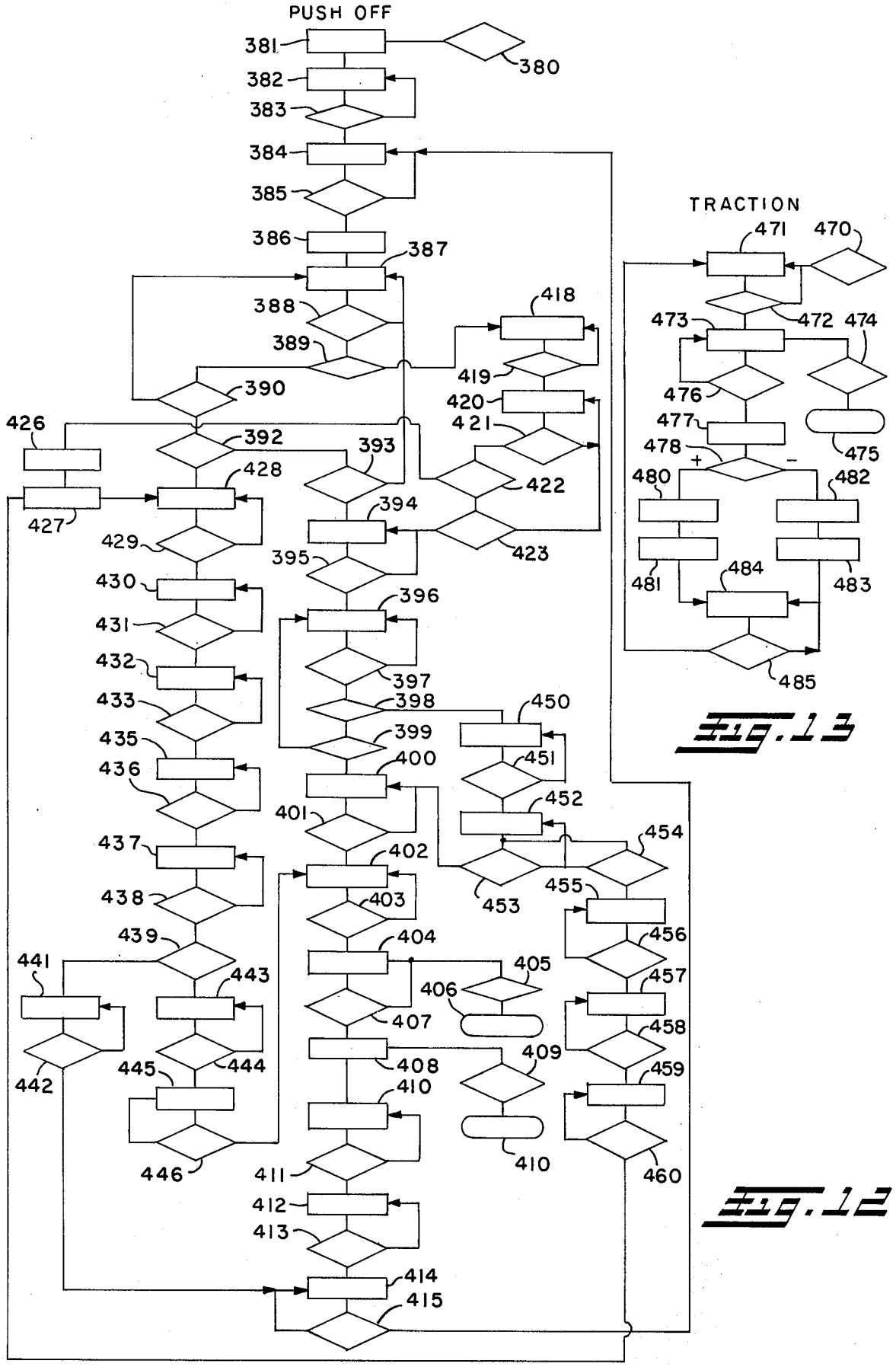
FIG. 12 is an exemplary program flow chart diagram for the programable controller for the push-off register.
FIG. 13 is a similar program flow chart diagram for the traction register.

Push-Off Program Register—FIG. 12

Referring now to FIG. 12, from the auto mode indicated at 380 the program goes through two pause steps 381 and 382, and then through an enabling interrogatory step 383 to a return push-off slow step 384. The next step is an interrogatory 385 inquiring whether the pump horsepower is over a preset limit and thus the push-off is returned. If not, the program remains in the position 384 until the push-off is in its full returned position. When the interrogatory step 385 indicates yes, the next step 386 enables S20 which is the full back position of the push-off. Step 386 also strobes the command and feed-back counters of the push-off.

The next step is a pause indicated at 387 followed by an interrogatory 388 asking whether the push-off is returned. If not, the program will remain in the pause step.

If the push-off is fully returned, the next step is a coring interrogatory 389. If coring is not taking place, the program moves then to interrogatory 390 which simply asks if the guard is in place. If not, the program returns to pause 387.

If the safety guard is in place, then the next step is interrogatory 392 which asks if the machine is clear or running wooden blocks, or if the cake is too small and is to be rejected. If neither condition exists, the next step is interrogatory 393 which asks if the squeeze cylinders are clear of the carriage. If not, the program again returns to the pause step 387.

If the squeeze cylinders are clear, the next step commences retraction of the carriage cylinder to move the mold from the squeeze position to the push-off position. The next step 394 retracts the carriage cylinder 31 and advances the close-up plate by extending cylinder 29. The next step in the program is an interrogatory inquiring as to when the carriage is halfway. When halfway the interrogatory 395 permits the program to move on to the next step 396. Otherwise the program remains in step 394. Step 396 holds the close-up plate fully advanced.

The interrogatory 397 determines whether the carriage is in the push-off position. If not, the program remains in step 396. The next step 398 determines whether certain inspection procedures are to be followed. If not, the program moves on to machine timer interrogatory 399 and at the command of the machine timer step 400 starts the push-off moving to its position No. 1 seen in FIGS. 7 and 8, which is the calculated position R12 from the calculate register. Step 400 not only enables R12 but also strobes the push-off command counter and resets interrogatory or flag 390 with regard to the position of the guard in place. Step 400 also advances both a totalizing counter which counts the number of molds and also the counter for the oversize mold. At this time the pusher moves to the No. 1 position and comes to a complete stop or to a null point.

The next step is interrogatory 401 which asks if the push-off is at No. 1 position. It also asks if the close-up has returned. If not, the program remains in step 400; if position 1 has been achieved, the program moves on to step 402 enables R14 which is the calculated position 2 and again strobes the command counter of the push-off. The push-off now moves to the calculated position No. 2. The next step is interrogatory 403 which determines whether the push-off is in the No. 2 position. If not, the program remains in step 402; if position 2 is attained, the program moves on to step 404.

With the push-off in the No. 2 position, it is now ready to move to the zero position or the far righthand end of its stroke as seen in FIG. 8 with the help of the traction device. Since in such position it is clear of the transfer carriage for moving the mold from the squeeze position to the conveyor or push-off position, this step of the program can now be employed to return the carriage and also to institute a required pattern spray, if necessary.

Accordingly, the step 404, in addition to resetting the push-off command counter to move to the zero position with its ramp start, may also pass through a push-off past auxiliary position interrogatory 405 which if yes returns the carriage to the squeeze position as indicated at 406.

The next step 407 is an interrogatory inquiring whether the carriage cylinder has been returned halfway. If not, the program remains in step 404; if yes, step 408, continues to command the push-off to the zero position with its ramp start and also energizes spray timer 409 which is disabled at step 410 when the time step 409 times out.

The next step 410 continues to push-off to the zero position with its ramp start while the interrogatory 411 determines whether the push-off is at its zero position. The next step 412 is a slight delay step followed by interrogatory 413 determining whether the transfer carriage is at the squeeze position. If the carriage is at the squeeze position, and thus clear of the push-off, the next step 414 enables S20 which is the push-off full back position and strobes the command counter of the push-off. The final step in the sequence is the interrogatory 415 which determines whether the push-off is in the return mode and whether the transfer carriage is at squeeze. If not, the program remains in step 414 and if yes, the program returns to step 384.

The above described sequence is the most simple sequence the push-off can move through in a given cycle of the machine. The above sequence assumes that no coring is taking place, that the machine is not in the clear mode utilizing wooden blocks, that the cake is not too small or rejected, and that the inspection mode flag is not high.

If the machine is in a coring mode, the above described program is modified only slightly. If the coring flag or interrogatory 389 is high, the next step is 418 which simply keeps the safety guard open and the program holding until coring is complete. The next step in the coring mode is step 419 which simply asks if the guard is still open. If not the program remains in step 418. If it is still open, the program goes on to a further pause step 420 which may be terminated either by the operator manually placing the guard in place or by the coring mechanism automatically doing so. As soon as the guard is in place, the next step or flag 421 will permit the program to go on to the next step which is interrogatory 422. Otherwise, the program remains in step 420. The step 422 inquires whether the machine is in the machine clear mode, using wooden blocks, or whether the cake is too small or rejected. If not, the program goes on to step 423 which inquires whether the squeeze cylinders are clear. If they are, the program rejoins the above described sequence at step 394.

If the interrogatory or flag 422 is high indicating that the machine is in the clear mode or that the cake is too small or otherwise reject, the next two steps are pause steps 426 and 427 leading to step 428 commencing what may be termed the reject cycle. It will be appreciated that this step may be achieved also by the flag 392 in the high mode signalling that the machine is in its clear mode or that the sand cake is too small and thus is to be rejected.

The step 428 enables S19 which is the push-off clear of the carriage or auxiliary position and strobes the command counter of the push-off. This moves the push-off to an auxiliary position ahead of the sand cake as it is presented to the push-off from the squeeze position.

The next step 429 indicates whether the push-off is in the auxiliary position, and if not, the program remains in step 428. When the push-off is in auxiliary position, the next step is to retract the carriage cylinder as indicated at 430. As in the normal cycle, the next step 431 indicates whether or not the carriage has obtained the halfway point. If it has, the next step 433 moves the push-off to its auxiliary position in which it is ahead of the carriage. The step 434 determines if the carriage is in the push-off position. If not, the program remains in step 433. The next step 435 again directs the pusher to the auxiliary position and resets several of the interrogatory flags. The step 436 asks if the close-up plate has returned. If the close-up has returned, the next step is 437 enable S20 which is the full back position of the push-off and strobes the command counter of the push-off moving the push-off to its full return position. The next step 438 simply inquires if the push-off is in its full back position; if not, the program remains in the step 437.

The step or flag 439 asks if the machine is in the clear mode wherein wooden blocks are being used to clear the machine and conveyor. If not, the program moves to a hold step 441 commanding the carriage to return. The interrogatory 442 permits the program to move then to step 414 of the main program which enables S20 and strobes the command counter of the push-off to require the push-off to move to its full return position.

If the machine is in the clear mode, the interrogatory 413 will direct the program to the next step 443 which opens the safety guard. As soon as the safety guard is open the interrogatory 444 permits the program to move to the pause step 445 at which time the operator places the wooden block in place and manually closes the guard. As soon as the guard is in place, the step 446 permits the program to move to the step 402 of the main program which moves the push-off directly to the No. 2 position and through the remainder of the program cycle. The insertion of the wooden blocks clears the machine without requiring the production of molds.

If the machine includes a visual inspection mode, then the interrogatory 398 will move the program to step 450 which opens the safety guard. As soon as the safety guard is open the interrogatory 451 permits the program to move on to a pause step 452 during which the operator may closely visually check the mold. He may also perform a number of tests on the mold if desired such as for hardness. If the mold is satisfactory, the operator then closes the guard at step 453 and the program returns to step 400 which enables R12 and strobes the command counter of the push-off.

If the sand cake or mold does not pass inspection, the program moves to a reject step 454 which may be obtained by the operator simply engaging a reject push-button. This causes the machine cycle at this point simply to reverse itself and the program moves into a pause step 455 until the squeeze cylinders are retracted to a clear position, the guard closed and the close-up returned as signalled by the step 456. When these have occurred the next step 457 requires the carriage cylinder to return the carriage to the squeeze position. When the carriage cylinder is halfway as indicated by step 458 the program moves on to a pause step 459 followed by an interrogatory 460 inquiring whether the carriage has returned to the squeeze position. If it has, the program then moves to the pause step 427 in the reject cycle and the reject program sequence then takes place with the push-off moving to the auxiliary position, the carriage then returning to the push-off position, and retraction of the push-off rejecting the cake from the machine to the left as seen in FIGS. 1 and 2.

It is noted that the push-off in moving to the No. 1 position and then to the No. 2 position and finally to the zero position is moving by command from a calculated dimension obtained during squeeze and no limit switches or pressure transducers are provided between the push-off and the cake.

Traction Program Register 16

Referring now to FIG. 13 it will be seen that the traction program register from the auto mode step 470 moves to a pause step and is held in the pause step by an enabling interrogatory 472. After properly enabled, the program moves to a return traction cylinder slow step 473 which ensures that the traction cylinder is fully retracted. A limit switch interrogatory 474 actuates a disable traction slow return step 475.

An interrogatory 476 inquires whether the push-off is at the No. 2 position. If yes, the program moves on to pause step 477 and then on to traction offset step 478. The step 478 inquires whether the traction offset is plus or minus. If the traction offset is positive the next step 480 enables the traction offset S14 and strobes the traction command counter. Step 481 enables the push-off feed-back counter and strobes the traction feed-back counter.

If minus, the next step 482 enables S14 and strobes the traction feed-back counter while the next step enables the push-off feed-back counter while strobing the traction command counter. In either case the following step is a pause step 484 followed by an interrogatory asking if the push-off register is in step as indicated at 485. As soon as the push-off register is in step, the control of the traction device is transferred to the program register of the push-off at step 404 of FIG. 12 when the push-off moves from the No. 2 position to the zero position with the controlled ramp start.

SUMMARY

It can now be seen that there is provided a horizontal stack foundry molding machine utilizing a solid state programmable controller in conjunction with a hydraulic closed loop servo-system.

The finished mold thickness can be dialled in with a minimum allowable size, i.e. the controls will calculate the proper blow chamber dimension and position, which will result in a finished mold of the proper dimension. The control system takes into account the pattern stool and pattern thickness, the amount of sand compressibility, and the error from the previous cycle. The controls calculate the mold thickness and final squeeze dimension of the rear cylinder mold or pattern face, and store the information for controlling the push-off cylinder.

As seen in FIG. 8, the pusher cylinder will advance and slow down just before contacting the new mold by using the squeeze position of the rear cylinder mold face or pattern as a reference. Then it will advance rapidly and slow down again just before contacting the stack of molds using the mold thickness dimension calculated previously.

At this point, from the No. 2 position, the pusher and traction device will advance the entire mold stack as a unit. The pusher cylinder is the controlling cylinder and the traction cylinder mimics the pusher cylinder. Synchronization is achieved by sensing the position with optical encoders driven by the cylinder rods. The system senses the position error in the pulse output from the pusher cylinder and traction cylinder, and the traction cylinder servo-pump will receive the proper command to reduce the error signal to zero, keeping the molds closed without crushing. Also, as indicated in FIG. 8, the mold stack will start slowly with the desired ramp speed and then advance rapidly until the pusher cylinder has completed its stroke.

If the coring mode has been selected, the safety guard will retract when the pusher has returned. After coring, the operator manually closes the guard which continues the machine cycle.

If the inspection mode has been selected, the carriage cylinder shuttles the mold from the squeeze station to the push-off station. At this time, the guard will retract, permitting inspection of the mold. If the reject button is pushed, and then the guard closed, the carriage with the mold will return to the squeeze station and the pusher will extend to the auxiliary position. The carriage with the mold then returns to the push-off station and the retracting pusher will eject the mold from the back of the machine.

The control system also permits positioning of the squeeze cylinders not only with respect to each other but also with respect to the blow opening from the reservoir. In this manner, the final squeeze mold thickness corresponds to a dialed-in dimension and is positioned to take advantage of pattern configurations. Furthermore, if the mold thickness is below the selected minimum dimension, the machine will automatically eject the mold.

Each squeeze cylinder has separate, independent controls for slow draw. There are three adjustments for each, these being slow draw, acceleration rate to slow draw speed, and slow draw speed.

The machine has the capability of being cycled through a complete automatic cycle one step at a time by means of the program monitors and digital read-outs seen at 26, 27, and 286 and 287 in FIG. 10. This aids in checking out and servicing the machine.

If the "clear" mode has been selected, the machine will not fill the reservoir with new sand but will simply dry cycle the machine. The mold carriage then shuttles to the push-off station and the guard retracts. At this point the operator places a wooden block made to the desired size in contact with the mold stack. After closing the guard, the pusher advances the entire mold stack pushing on the wooden block. In this manner the entire pouring section of the mold stack can be emptied without loss of molds that can be poured.

The machine also has the capability to produce an oversize mold to act as a buffer mold after the last poured mold of a batch. When the pourer comes back with a filled ladle, he should be able to pour the oversize mold. This eliminates skipping of a mold when starting to pour from a newly filled ladle. The frequency of the oversize mold can be adjusted to coincide with the number of molds that can be poured from one ladle.

In any event, at final squeeze position, the size and relative position of the cake is measured and stored in the control system. The position information is used to effect a soft or null point contact between the pusher plate and the new mold.

The size information is used to slow the pusher down to a complete stop at precisely the contact point. Again, this gives a very smooth contact between the new mold and the previous stack. From this point on the traction cylinder mimics the pusher cylinder with an accuracy of plus or minus 1/1000 inch. The physical position of the cylinders is derived from optical pulse encoders.

Because of the physical knowledge of the size and position of the new cake and the stack, this system is not subject to variances due to different temperatures at the beginning of a shift and at the end of a shift. A system that is predicated on reading pressures or using pressure transducers that are reflected in a cylinder has no knowledge whether or not the pressure is the sole product of the load that it is pushing or if it is the coefficient of friction which may have changd due to temperature or moisture or corrosion on the bearings. Therefore it could conceivably respond to pressure changes that are not caused by the sand molds but by some other irrelevant factor.

Again, an important part of the present invention is that the system which uses actual positions as the controlling factor doesn't respond to parameters that might change as the day progresses. Moreover, the system of the present invention has the flexibility of a dialed in fixed amount of interference which would tend to seal the parting surfaces. The amount of looseness in the mechanical system can be compensated for by dialling in a certain dimension, the net effect of which would be that the traction device cylinder moves the preset distance before the pusher advances. This would be used to take up slack in the gears and chains of the traction system.

In any event the system of the present invention is a repetitive system as opposed to a hydraulic pressure system which may fluctuate due to pressure changes not caused by the sand mold. The machine may operate at maximum speed since the control knows exactly where the cakes are at all times. It doesn't have to feel its way cautiously before making contact with the new mold and the stack of molds.

Other modes of applying the principles of the invention may be employed, change being made as regards the details described, provided the features stated in any of the following claims or the equivalent of such be employed.

I claim:

1. A horizontal stack foundry molding machine, comprising forming means for forming molds, variable speed pusher means for moving each newly formed mold from said forming means toward a station at which a plurality of molds may be movably stacked for casting, control means responsive to said forming means for controlling the speed of said pusher means to engage such newly formed mold at a relatively slow speed and then to move the latter toward such station, and sensor means for sensing a physical parameter of each newly formed mold, and wherein said control means includes means for responding to such parameter to control movement of said pusher means.

2. The machine of claim 1, wherein said control means includes means for operatively controlling said pusher means to move the same relatively rapidly toward a newly formed mold, to decelerate the same prior to engagement with such mold, to bring the same into engagement against a surface of such mold, and to accelerate the same to move such mold toward such station.

3. The machine of claim 2, wherein said means for operatively controlling includes means for decelerating said pusher means to engage such mold surface at substantially zero velocity

4. The machine of claim 2, wherein said control means further includes means for controlling operation of said pusher means to push such newly formed mold relatively rapidly toward a stack of molds at such station, to decelerate such newly formed mold prior to engagement with such stack, to engage such newly formed mold against such stack, and to accelerate such newly formed mold and such stack to transfer the same through such station.

5. The machine of claim 4, wherein said means for controlling includes means for decelerating said pusher means to engage such mold surface at substantially zero velocity, and wherein said means for controlling operation includes further means for decelerating said pusher means and such mold to substantially zero velocity upon engaging such stack.

6. The machine of claim 5, wherein said forming means comprises an open ended mold box, means for ramming a foundry mold into said box, means for horizontally shifting such mold to a position of alignment with a pouring and cooling conveyor, said pusher means being operable to push such newly formed mold onto said conveyor against a stack of previously formed molds and to move such stack along said conveyor, means for measuring the thickness of such mold as it is rammed in said box, and wherein said control means includes means responsive to the measured thickness of such mold for varying the speed of said pusher means.

7. The machine of claim 1, wherein said forming means comprises means for making a sand cake mold having a pattern in at least one surface thereof, said sensor means comprise means for measuring the thickness of such mold, means for placing such mold in alignment with a pouring and cooling conveyor capable of containing a horizontal stack of such molds, and wherein said control means includes means responsive the final position of one pattern during forming and to the measured thickness of such mold for determining the relative instants of acceleration and deceleration of said pusher means.

8. The machine of claim 1, wherein said sensor means comprises means for measuring the actual thickness of each newly formed mold.

9. The machine of claim 1, wherein said sensor means comprises means for measuring the actual position of at least one surface of each newly formed mold relative to a reference position.

10. The machine of claim 1, wherein said sensor means comprises optical encoder means for producing an electrical output representative of such parameter, and further comprising further optical encoder means for producing a further electrical output representative of the actual position of such pusher means, and wherein said control means includes means responsive to such electrical outputs to control the speed of said pusher means.

11. The machine of claim 1, further comprising traction means for moving a plurality of stacked molds.

12. The machine of claim 11, further comprising means responsive to such measured parameter for operating said traction means to move such plurality of stacked molds.

13. The machine of claim 12, wherein said pusher means is operable to push such stacked molds and said control means includes means for synchronizing said means for operating to move said traction means in synchronism with said pusher means.

14. The machine of claim 12, wherein said control means includes means for synchronizing said means for operating to effect movement of said traction means in synchronism with said pusher means.

15. The machine of claim 14, wherein said means for synchronizing includes means for uniformly accelerating and moving said traction means with said pusher means when the latter and such mold have engaged with such stacked molds.

16. The machine of claim 14, wherein said means for synchronizing includes plus or minus offset means for varying the instant of acceleration and subsequent movement of said traction means relative to that of said pusher means after the latter and such mold have engaged such stacked molds.

17. The machine of claim 1, wherein said forming means comprises a mold box with at least two substantially parallel walls, at least one of which is movable and has a pattern thereon to form the same in each mold, and said sensor means comprises means for sensing the relative position of said at least one wall, and wherein said control means includes means responsive to such sensed position for controlling movement of said pusher means relative to each mold.

18. The machine of claim 17, wherein said sensor means includes means for sensing the final positions of both said walls when forming a mold as an indication of the thickness thereof.

19. The machine of claim 17, wherein said sensor means includes means for sensing the final relative position of at least one parallel face of the mold in the machine.

20. The machine of claim 19, wherein said sensor means includes means for sensing the final positions of both said walls when forming a mold as an indication of thickness thereof.

21. The machine of claim 20, further comprising further sensor means for sensing the actual position of said pusher means in the machine, and wherein said control means includes calculator means for calculating respective instants of acceleration and deceleration of said pusher means from such sensed positions.

22. The machine of claim 17 including a blow slot communicating with said box for charging said box with sand, and means to select the position of said walls vis-a-vis said blow slot prior to charging said box with sand.

23. The machine of claim 17, further comprising further sensor means for sensing the actual position of said pusher means in the machine, and wherein said control means includes means responsive to the sensed positions of said at least one wall and said pusher means for controlling the instants of acceleration and deceleration of said pusher means.

24. The machine of claim 1, wherein said pusher means is located in the machine to push against a face of each newly formed mold, said sensor means comprises means for sensing the actual position of such face in the machine and producing an electrical output indicative thereof, further sensor means for sensing the actual position of said pusher means in the machine and producing a further electrical output indicative thereof, and wherein said control means includes circuit means responsive to such electrical outputs for accelerating and moving said pusher means toward such mold face, decelerating said pusher means to engage such mold face at substantially zero velocity, and accelerating and moving said pusher means and such mold toward such station.

25. The machine of claim 1 wherein said control means operates to stop said pusher means at such newly formed mold and to stop such mold at the stack being formed.

26. The machine of claim 25 wherein the two stop positions are obtained by measured dimensional parameters of the mold at the conclusion of forming.

27. The machine of claim 1 including means to measure the dimensional parameters of the mold at the conclusion of forming, means to compare the measured dimensional parameters against preselected dimensional parameters, and means responsive to such comparison to adjust said forming means after each forming cycle.

28. The machine of claim 1 wherein said forming means comprises a mold box with at least one movable wall, having an initial and a final position, said control means including means to measure the final thickness of the mold, means to compare such final thickness against an optimum thickness, and means to adjust the initial position of said wall as a result of the comparison.

29. The machine of claim 1 wherein said forming means comprises a mold box with at least one movable wall, and means to measure the final position of such wall at the conclusion of forming.

30. The machine of claim 1 wherein said forming means comprises a mold box with opposed movable walls, and means to measure the final position of both such walls at the conclusion of forming.

31. The machine of claim 30 including means to calculate the mold thickness from such measurements.

32. A stack molding machine, comprising forming means for forming molds, transfer means for transferring newly formed molds toward a station at which a plurality of molds may be stacked for casting, sensor means for sensing at least one actual dimensional parameter of each mold, and control means responsive to such parameter for controlling operation of said transfer means.

33. The machine of claim 32, wherein said forming means comprises a pair of substantially parallel walls, at least one of which is movable and has a pattern thereon for imparting such pattern to a mold formed thereby, said transfer means including pusher means for pushing against one face of such mold to move such mold toward such station, and said sensor means including means for detecting the actual position of the forming means wall that forms such one face as such dimensional parameter indicating the relative position of such one face in the machine.

34. The machine of claim 33, wherein said pusher means is positioned to push such mold in a forward direction toward such station, said pair of walls comprises forward and rear walls, at least the rear one of which is movable, and wherein said sensor means comprises encoder means for detecting the final position of said rear wall in the machine when forming such mold.

35. The machine of claim 34, further comprising means for detecting the actual position in the machine of said pusher means, and wherein said control means includes circuit means responsive to the detected final position of said rear wall and the detected position of said pusher means for relatively rapidly moving said pusher means toward such mold face and for decelerating said pusher means to engage such mold face at a relatively slower speed.

36. The machine of claim 35, wherein said circuit means includes means for moving said pusher means to engage such one face at substantially zero velocity.

37. The machine of claim 35, wherein both said walls are movable, and further comprising additional encoder means for detecting the actual final position of said forward wall in the machine when forming such mold, whereby the difference between the outputs of said encoder means and said additional encoder means represents the thickness of such mold, and wherein said control means includes additional circuit means responsive to such thickness of such mold for decelerating said pusher means and such mold to engage such stack of molds at a relatively slow speed.

38. The machine of claim 37, wherein said additional circuit means includes means for decelerating said pusher means and such mold to engage such stack of molds at substantially zero velocity.

39. The machine of claim 37, further comprising traction means for moving a plurality of such stacked molds beyond such station thereby to relieve pressure on at least the initial mold in such stack as said pusher means pushes such mold thereagainst, and additional circuit means for synchronizing operation of said traction means with that of said pusher means.

40. A stack molding machine, comprising forming means for forming molds, pusher means for moving newly formed molds from said forming means toward a pouring station at which a plurality of molds may be movably stacked, said pusher means including a front wall for engaging a rear face of a mold to push the same toward such station and a rear wall, sensor means for sensing a dimensional parameter of each newly formed mold, and control means responsive to the sensing of an undersized mold smaller than a predetermined size for causing the rear wall of said pusher means to engage such mold to push the same away from such stack.

41. The machine of claim 40, wherein said forming means comprises a mold box with two substantially parallel walls, at least one of which is movable and has a pattern thereon to form the same in each mold, and wherein said sensor means comprises means for detecting the position of said at least one wall when the latter is in final position to form a mold as an indication of such dimensional parameter of such mold.

42. The machine of claim 41, wherein both of said walls are movable, and wherein said sensor means includes further means for detecting the position of the other of said walls when in final position to form a mold as an indication of the mold thickness.

43. A horizontal stack foundry molding machine comprising a mold box, a blow slot in such box through which molding sand is blown into such box, and at least one movable wall operative to compress sand in such box to form a mold after sand is blown into such box, power means for moving such wall from an initial position to a final position to form a mold, monitor means for sensing the position of said wall, pressure means for controlling the final position of said wall, and means responsive to the final sensed position of said wall to control the initial position of said wall for the next mold.

44. A machine as set forth in claim 43 including means to derive the mold thickness from the final position of said wall for controlling transfer subsequent transfer of the mold.

45. A machine as set forth in claim 44 including means to derive the mold thickness from the final sensed position of said wall, means to compare such thickness with an optimum thickness, and means to adjust the initial position of said wall accordingly.

46. A machine as set forth in claim 43 including means to adjust the initial position of said wall with respect to said blow slot.

47. A machine as set forth in claim 43 wherein said wall contains a pattern, and means to move said wall to a clear position wherein the pattern is clear of the mold, and means to adjust said clear position.

48. A machine as set forth in claim 43 including control means responsive to said monitor means to cause said power means to draw the pattern from the mold at a selected acceleration and speed at a selected extent.

* * * * *